US007603984B2

(12) United States Patent
Ganser

(10) Patent No.: US 7,603,984 B2
(45) Date of Patent: Oct. 20, 2009

(54) ACCUMULATOR INJECTION SYSTEM FOR AN INTERNAL COMBUSTION ENGINE

(75) Inventor: Marco Ganser, Oberägeri (CH)

(73) Assignee: Ganser-Hydromag AG (CH)

( * ) Notice: Subject to any disclaimer, the term of this patent is extended or adjusted under 35 U.S.C. 154(b) by 73 days.

(21) Appl. No.: 11/995,193

(22) PCT Filed: Jul. 10, 2006

(86) PCT No.: PCT/CH2006/000364

§ 371 (c)(1),
(2), (4) Date: Jan. 9, 2008

(87) PCT Pub. No.: WO2007/009279

PCT Pub. Date: Jan. 25, 2007

(65) Prior Publication Data

US 2008/0296413 A1 Dec. 4, 2008

(30) Foreign Application Priority Data

Jul. 18, 2005 (CH) ..... 1195/05
Aug. 19, 2005 (CH) ..... 1365/05

(51) Int. Cl.
*F02M 69/46* (2006.01)
*F02M 59/46* (2006.01)

(52) U.S. Cl. ..... 123/456; 123/467

(58) Field of Classification Search ..... 123/456, 123/467, 468, 469
See application file for complete search history.

(56) References Cited

U.S. PATENT DOCUMENTS 4,142,497 A * 3/1979 Long ..... 123/456
4,719,889 A * 1/1988 Amann et al. ..... 123/447
5,199,402 A * 4/1993 Melchior ..... 123/447

(Continued)

FOREIGN PATENT DOCUMENTS

DE 31 19 050 11/1982

(Continued)

OTHER PUBLICATIONS

English language translation of DE 101 12 154 Abstract as supplied from the esp@cenet databade—Worldwide.

(Continued)

*Primary Examiner*—Thomas N Moulis
(74) *Attorney, Agent, or Firm*—Hershkovitz & Associates, LLC; Abraham Hershkovitz

(57) ABSTRACT

Disclosed is a high-pressure accumulator injection system (10) for an internal combustion engine, preferably a diesel engine. Said injection system (10) comprises a number of injection valves (18) which are connected to a high-pressure conveying device (12) via fuel pipes (16, 14). A reservoir (22) and a check valve encompassing a bypass throttle (24) that is connected in parallel are assigned to each injection valve (18). Said check valve which is assigned to each injection valve (18) and encompasses a bypass throttle (24) that is connected in parallel allows the accumulator injection system (10) to perform stable and reproducible injection processes with a favorable pressure curve during each injection process even when the discrete reservoirs (22) are provided with an unusually low volume. The reservoirs (22) can be integrated in the housing of the injection valves (18). The inventive injection system dispenses with the need for a complex common rail.

16 Claims, 12 Drawing Sheets

U.S. PATENT DOCUMENTS

| | | | | |
|---|---|---|---|---|
| 5,311,850 | A * | 5/1994 | Martin | 123/456 |
| 5,497,750 | A | 3/1996 | Mueller et al. | |
| 5,509,391 | A | 4/1996 | DeGroot | |
| 5,732,679 | A * | 3/1998 | Takahasi et al. | 123/467 |
| 5,868,111 | A | 2/1999 | Augustin | |
| 6,092,509 | A | 7/2000 | Tanabe et al. | |
| 6,220,224 | B1 * | 4/2001 | Matthies et al. | 123/468 |
| 6,363,914 | B1 * | 4/2002 | Tanabe et al. | 123/447 |
| 6,467,457 | B1 * | 10/2002 | Lei et al. | 123/456 |
| 6,684,856 | B2 * | 2/2004 | Tanabe et al. | 123/447 |
| 6,776,140 | B2 * | 8/2004 | Maier et al. | 123/456 |
| 2003/0183198 | A1 | 10/2003 | Mahr et al. | |
| 2006/0144366 | A1 | 7/2006 | Magel | |

FOREIGN PATENT DOCUMENTS

| | | |
|---|---|---|
| DE | 32 27 742 | 5/1983 |
| DE | 197 06 694 | 9/1998 |
| DE | 198 42 067 | 3/2000 |
| DE | 101 12 154 | 9/2002 |
| DE | 102 10 282 | 9/2003 |
| DE | 102 38 951 | 3/2004 |
| DE | 103 07 871 | 9/2004 |
| EP | 0 228 578 | 7/1987 |
| EP | 0 264 640 | 4/1988 |
| EP | 0 657 642 | 6/1995 |
| EP | 0 921 302 | 6/1999 |
| EP | 1 002 948 | 5/2000 |
| WO | WO/2006/108309 | 10/2006 |

OTHER PUBLICATIONS

English language translation of DE 198 42 067 Abstract as supplied from http://v3.espacenet.com.

Article "Das Akkumulator-Common-Rail-Einspritzsystem für die MTU-Baureihe 8000 mit 1800 bar Systemdruck." Motortechnische Zeitschrift MTZ No. 61, Oct. 2000.

Article "Das Common Rail-Enspritzsystem—ein neues Kapitel der Dieseleinsprtiztechnik." Motortechnische Zeitschrift MTZ No. 58, Oct. 1997.

U.S. Appl. No. 11/911,515, filed Oct. 12, 2007.

Publication SAE Paper 910 184 (1991).

IPER for PCT/CH2006/000364 dated Oct. 9, 2007.

* cited by examiner

ACCUMULATOR INJECTION SYSTEM FOR AN INTERNAL COMBUSTION ENGINE

The present invention relates to an accumulator injection system for the intermittent injection of high-pressure fuel into combustion spaces of an internal combustion engine.

An accumulator injection system of this type is known from DE 102 10 282 A1. Conveying assemblies convey fuel out of a fuel reservoir in order to feed at least one high-pressure line to the cylinders of the combustion engine. A number of fuel injectors are fed via the at least one high-pressure line and in each case contain injector nozzles feeding fuel to a combustion space of the internal combustion engine. The at least one high-pressure line comprises line segments, by means of which the individual fuel injectors are connected to one another. The injector bodies of the fuel injectors comprise an integrated accumulator space. The accumulator spaces are used instead of a common-rail component, and each accumulator space has a volume which corresponds to 50 times to 80 times the maximum injection quantity of a fuel injector per injection operation. Each accumulator space is acted upon by means of an inflow throttle with fuel which is under high pressure. These inflow throttles are designed in such a way that multiple successive injection operations are possible, without pressure pulsations arising in the line segments. The influencing of other fuel injectors is avoided.

A fuel injection system disclosed in DE 32 27 742 employs injection valves which are equipped with an accumulator space. During the injection operation, the fuel which is under high pressure in the accumulator space is partially expanded, at the same time with a pressure drop, in the accumulator space. As a result, the law of injection, that is to say the time profile of the injection operation, has a characteristic falling from the start toward the end, this having an adverse effect on the combustion process of the internal combustion engine. Each accumulator space is connected to the high-pressure fuel conveying line via a narrowed orifice or a throttle passage. On account of the small flow cross-section area, the throttle passage prevents the occurrence of appreciable pressure waves in the fuel conveying lines during each injection operation. Such pressure waves would influence inadmissibly the uniform fuel distribution in a multi-cylinder engine and the stability of the injection operations of an individual injection valve from stroke to stroke.

EP 0 228 578 A proposes similar fuel injection valves to those in DE 32 27 742. In a design variant of these injection valves, a spring-loaded nonreturn valve is located between an annular bore around a guide element of the injection valve member and the accumulator space of the injection valve. The annular bore is connected to the fuel supply bore of the injection valve, and a bore connects the accumulator space to the rear side of the nonreturn valve, that is to say downstream of the nonreturn valve seat in the flow direction. The pressure in the accumulator space is therefore constantly lower than the pressure in the fuel supply bore, in particular at the commencement of each injection operation. As result, in the injection valve according to EP 0 228 578 A, the injection valve member can be closed reliably, even if the injection quantity is small.

The accumulator spaces of the injection valves known from DE 32 27 742 and from EP 0 228 578 A are located below a guide piston and a hydraulic control space of the injection valve member. A guide piston and control space belong to a hydraulic control device for controlling the movement of the injection valve member, and, in most operating states of the injection valve, it is necessary for the pressure below the guide piston to be lower than the pressure in the fuel supply bore during injection or even already at the commencement of injection, in order to ensure a sufficiently rapid closing of the injection valve member. The result of this, in many instances, is that the injection valve member becomes very long and is costly to produce. Moreover, this arrangement seriously restricts the freedom for accommodating the accumulator chamber in structural terms.

EP 0 264 640 A shows how, by shifting the volume of each individual injector accumulator into the line system, the overall system volume can be optimized and the disadvantages of the fuel injection systems known from DE 32 27 742 and EP 0 228 578 A can be overcome, while preserving the stability of the injection operations. In practice, according to EP 0 264 640 A, a line segment preceding all the injectors was designed with a larger internal cross section than the cross section of the remaining lines, so that this segment has a higher accumulator action than the remaining lines. This line segment was designated by the name of common rail, and the injection system was consequently called a "common-rail injection system". Reference may be made for comparison, for example, to the specialist article "Das Common Rail-Einspritzsystem—ein neues Kapitel der Dieseleinspritztechnik" ["The common-rail injection system—a new chapter in diesel injection technology"] from the Motortechnische Zeitschrift MTZ No. 58, October 1997.

DE 31 19 050 shows an injection valve with an accumulator chamber likewise integrated in the housing. The accumulator chamber is connected, unthrottled, to a feed pressure line which is connected to a fuel pump. This system, in which in each case an injection valve with a pressure line and a pump is shown as a unit, is suitable for very large diesel engines.

The injection systems according to DE 102 10 282 A1 and DE 32 27 742 have the essential disadvantage of the falling injection characteristic. In order to mitigate this, a very large accumulator chamber could be integrated in the injection valve here, but this has the disadvantage that the injection valve becomes bulky.

Injection valves both according to DE 32 27 742 and according to EP 0 228 578 A have the essential disadvantages of a long injection valve member and of the great restriction in the spatial arrangement of the accumulator space.

The practical implementation of the system according to EP 0 264 640 A has the line segment with a larger cross section. For example, in engines of the performance class above about 350 kW and up to 20,000 kW and above, this line segment is likewise highly bulky and costly. Furthermore, in numerous applications, for safety reasons, the common rail and the pressure lines must have a double-walled design for the event where a crack occurs. This further increases the outlay and costs for the common rail. Moreover, if the latter is fastened to the engine block, the problem arises that the different thermal expansion between the engine and the common rail gives rise to undesirable mechanical stresses. Sometimes, therefore, the line segment is subdivided into a plurality of shorter segments which are designed with a short line in each case to an injection valve, even amounting to the configuration of an individual accumulator. These individual accumulators are not accommodated in the housing of the injection valve, since the conditions of space in the engine cylinder head usually make it possible only to accommodate an injector accumulator which is too small. The commercial implementation of such a system can be read about, for example, in the specialist article "Das Akkumulator-Common-Rail-Einspritzsystem für die MTU-Baureihe 8000 mit 1800 bar Systemdruck" ["The accumulator common-rail injection system for the MTU construction series 8000 with a system pressure of 1800 bar"], published in the Motortechnische Zeitschrift MTZ No. 61, October 2000.

The design according to DE 31 19 050 makes it possible to have only the unit of an injection valve with integrated accumulator chamber, together with a pump and with the associated connecting line, since, when a plurality of injection valves are connected to an underdimensioned accumulator chamber via a relatively thin pressure line to a multi-cylinder pump, excessive dynamic pressure fluctuations arise which cannot be brought into phase with the injection operations and which inadmissibly influence the accuracy of the injection operations.

The object of the present invention is to develop an accumulator injection system of the type initially mentioned, in such a way that an optimal injection operation becomes possible even with smaller accumulator chambers.

This object is achieved by means of an accumulator injection system for the intermittent injection of high-pressure fuel into combustion spaces of an internal combustion engine, with a high-pressure conveying device which feeds high-pressure fuel to a number of injection units having in each case an injection valve, a discrete accumulator chamber assigned to the each injection valve and a throttling device, the injection units being connected to one another and to the high-pressure conveying device by means of hydraulic line means, and each injection valve having an injection valve member actuated by means of an actuator arrangement and a hydraulic control device for controlling the operation of injecting high-pressure fuel through nozzle injection orifices of a nozzle of the injection valve. The hydraulic line means have too low an accumulator action to ensure the required, reproducibly identical injection operations of the injection valves, and the throttling device permits, at least approximately unimpeded, the flow of the high-pressure fuel in the direction of the injection valve and throttles the flow in the opposite direction in such a way that high-pressure fuel flows to each injection valve during its injection operation both from the assigned accumulator chamber as well as from the accumulator chamber of other injection units and from the high-pressure conveying device.

A line segment of larger cross section, known as a common rail, is absent. It becomes possible to employ discrete accumulator chambers of such small volume that they can be integrated, as required, into the construction space of the injection valve housing. Each injection valve of the accumulator injection system is assigned such a discrete accumulator chamber. The spatial arrangement of the discrete accumulator chambers can be selected optimally with great freedom of configuration, since the accumulator chambers do not have to be located below the guide piston of the injection valve, as disclosed in DE 32 27 742 and EP 0 228 578 A. Furthermore, these discrete accumulator chambers are connected solely by means of pressure lines of relatively small cross section to one another and to a high-pressure conveying device common to all the injection valves. The cross section of these lines is such that they form, overall, a volume having too low an accumulator action to be capable alone of generating the required reproducibly identical injection operations of the injection valves. These line cross sections may be equal or else even unequal.

By a throttling device which permits the flow of the high-pressure fuel in the direction of the injection valve and throttles the flow in the opposite direction being assigned to each injection unit, it is possible, on the one hand, despite the utmost small discrete accumulator chambers, to control the pressure profile during the injection operation for all the injection valves of an internal combustion engine exactly and without a disturbing pressure drop, for which purpose the action of dynamic pressure waves is utilized. On the other hand, it is also possible to damp the dynamic pressure waves from an injection operation of one injection valve to the injection operation of the next injection valve or to make the dynamic pressure waves equal for each injection valve, to an extent such that all the injection operations take place under virtually identical conditions. Consequently, even the exact arrangement of the hydraulic line means - pressure lines - in the injection system no longer plays a major role, and this arrangement can be configured with a high degree of freedom geometrically and optimally in terms of cost.

The accumulator injection system according to the invention is suitable particularly for diesel engines, preferably of medium to higher performance. It may, however, also be employed in smaller diesel engines, such as are used, for example, in automobile construction.

The present invention is explained in more detail by means of preferred exemplary embodiments which are illustrated in the drawing and are described below. In the drawing, purely diagrammatically, FIG. 1 shows a diagrammatic illustration of an accumulator injection system according to the present invention with six injection units, each with an injection valve, an accumulator chamber and a throttling device, suitable for a six-cylinder engine, the hydraulic line means, such as the fuel feed line and fuel lines, and also the injection units being shown in longitudinal section;

FIG. 2 shows a longitudinal section through one of the six injection valves shown in FIG. 1, with an assigned discrete accumulator chamber and with a throttling device configured as a one-way nonreturn valve with a parallel-connected bypass throttle, on an enlarged scale, as compared with FIG. 1, the fuel flowing through the accumulator chamber assigned to the injection valve (=throughflow accumulator chamber);

FIG. 12 shows a graph on the same scale as FIG. 11, with the time-dependent pressure profiles at the inlet of the injection valves of an injection system on which FIG. 11 is based, but in which the injection valves are not assigned discrete accumulator chambers with a throttling device, but, instead, the fuel feedline is designed as a common rail with corresponding accumulator volumes;

Figure 11:
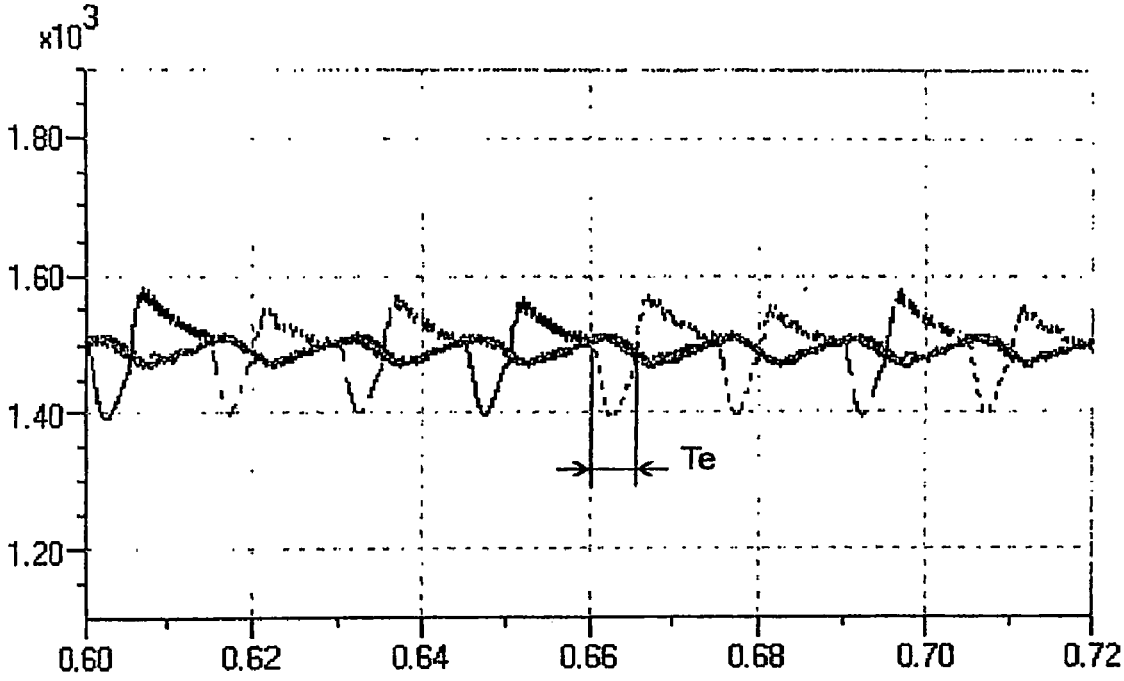
FIG. 11 shows a graph with time-dependent pressure profiles in the accumulator chambers and therefore at the inlet of the injection valve of an accumulator injection system according to FIG. 1 with eight injection units.
Figure 12:
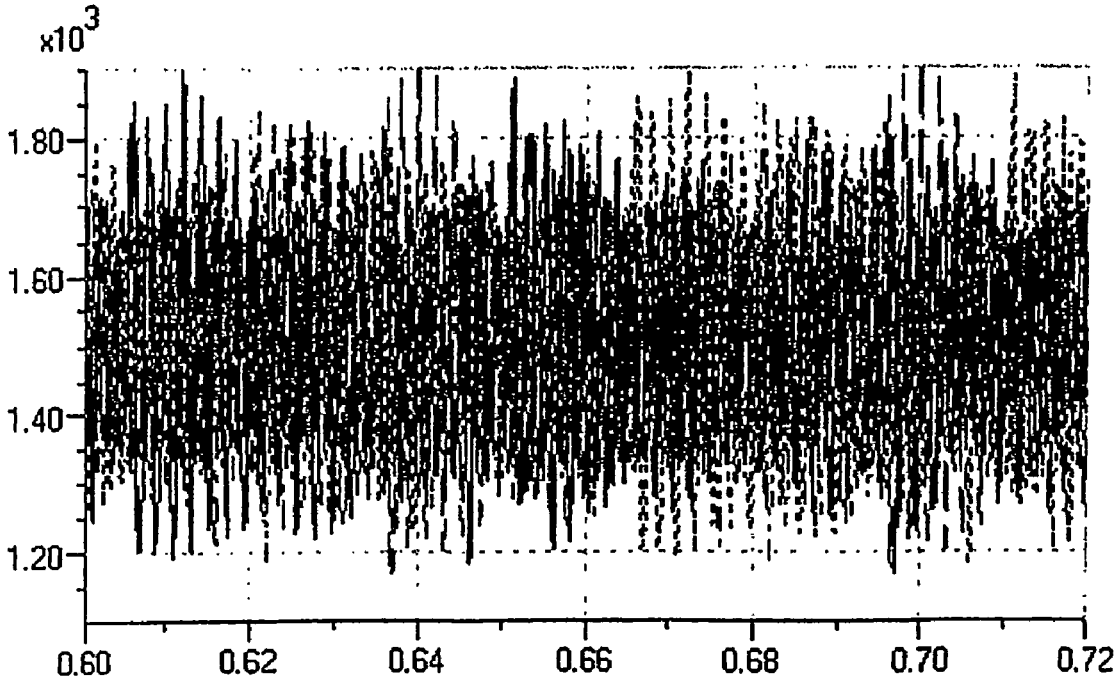
Figure 13:
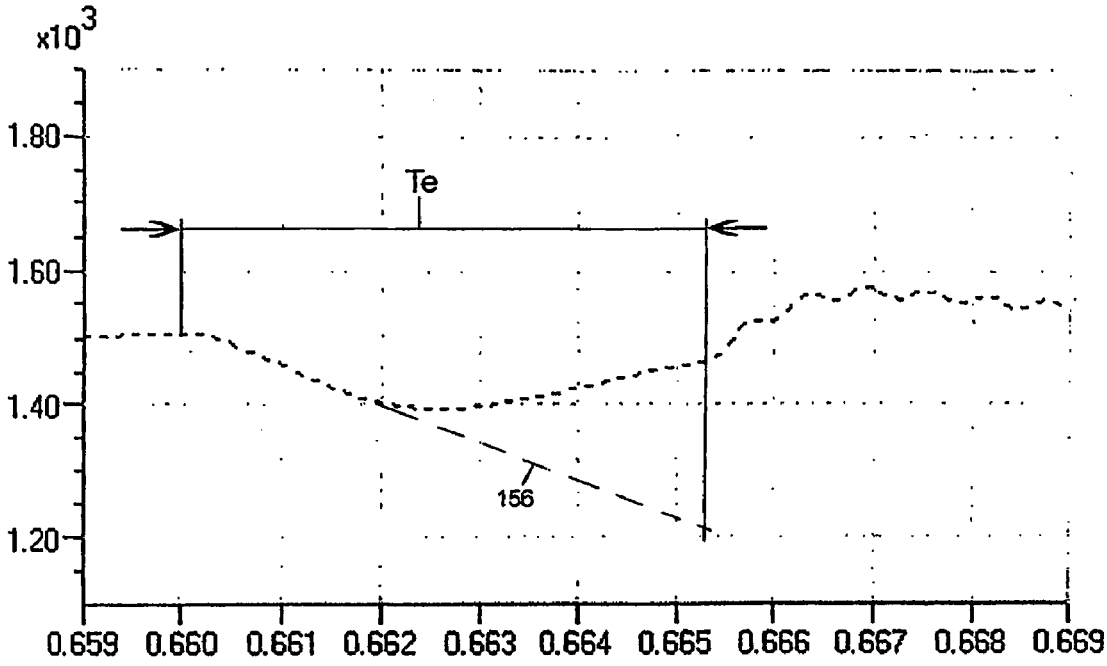
FIG. 13 shows an extract from the graph of FIG. 12 with the pressure profile in the accumulator chamber and therefore at the inlet of the injection valve during an injection operation of this injection valve.
Figure 14:
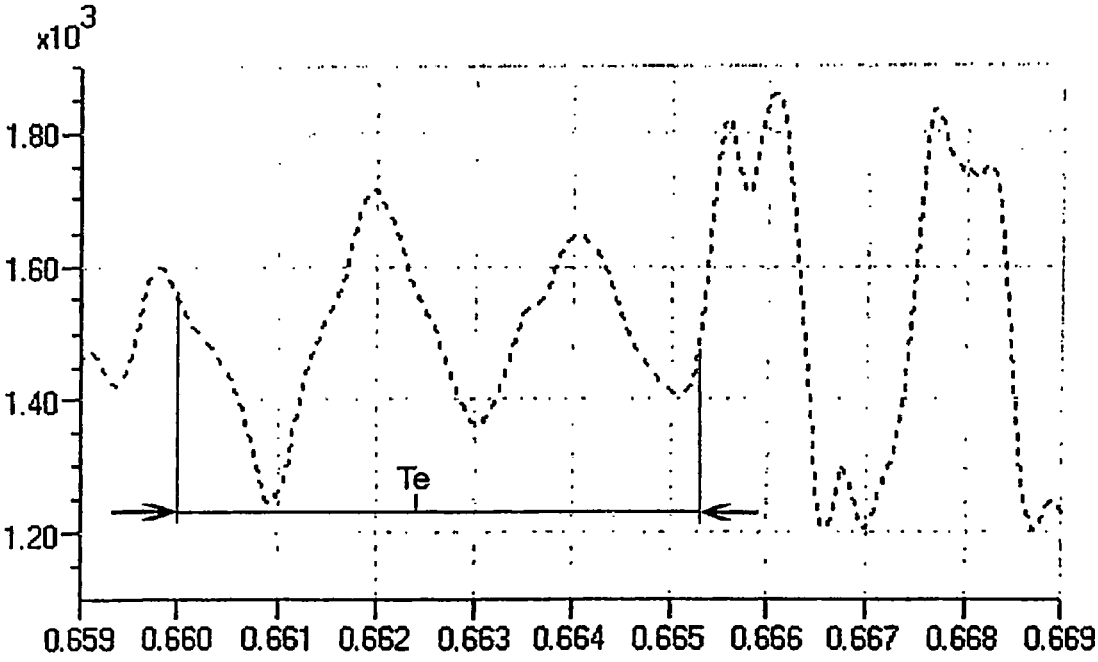
FIG. 14 shows, in an identical illustration to FIG. 13, a corresponding time extract from the graph of FIG. 12.
Figure 15:
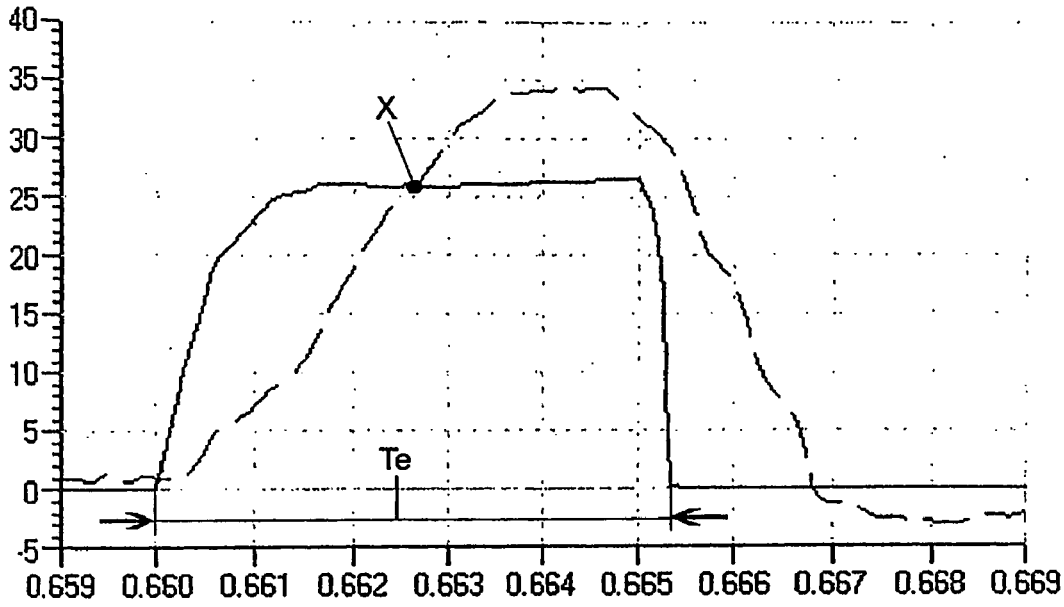
Figure 16:
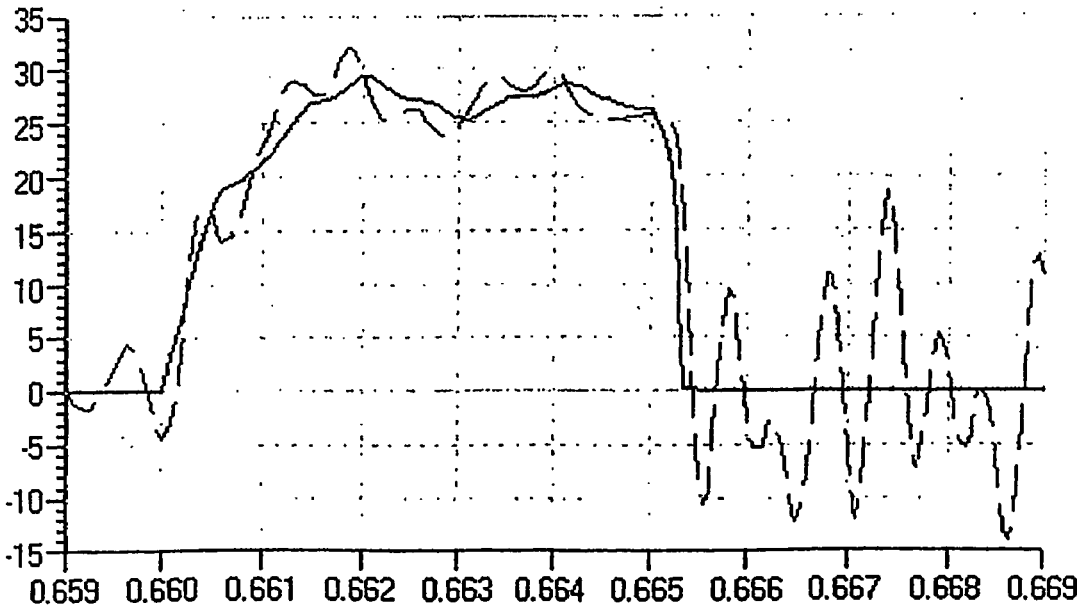

FIG. 15 shows a graph with the time-dependent profile of the fuel flow through the nozzle of an injection valve and of the fuel flow into the respective accumulator chamber during an injection operation according to FIGS. 11 and 13; and FIG. 16 shows, in an identical illustration to FIG. 15, the time-dependent profile of the fuel flow through the nozzle of an injection valve and of the fuel flow at the inlet of the injection valve during an injection operation according to FIGS. 12 and 14.

Figure 1:
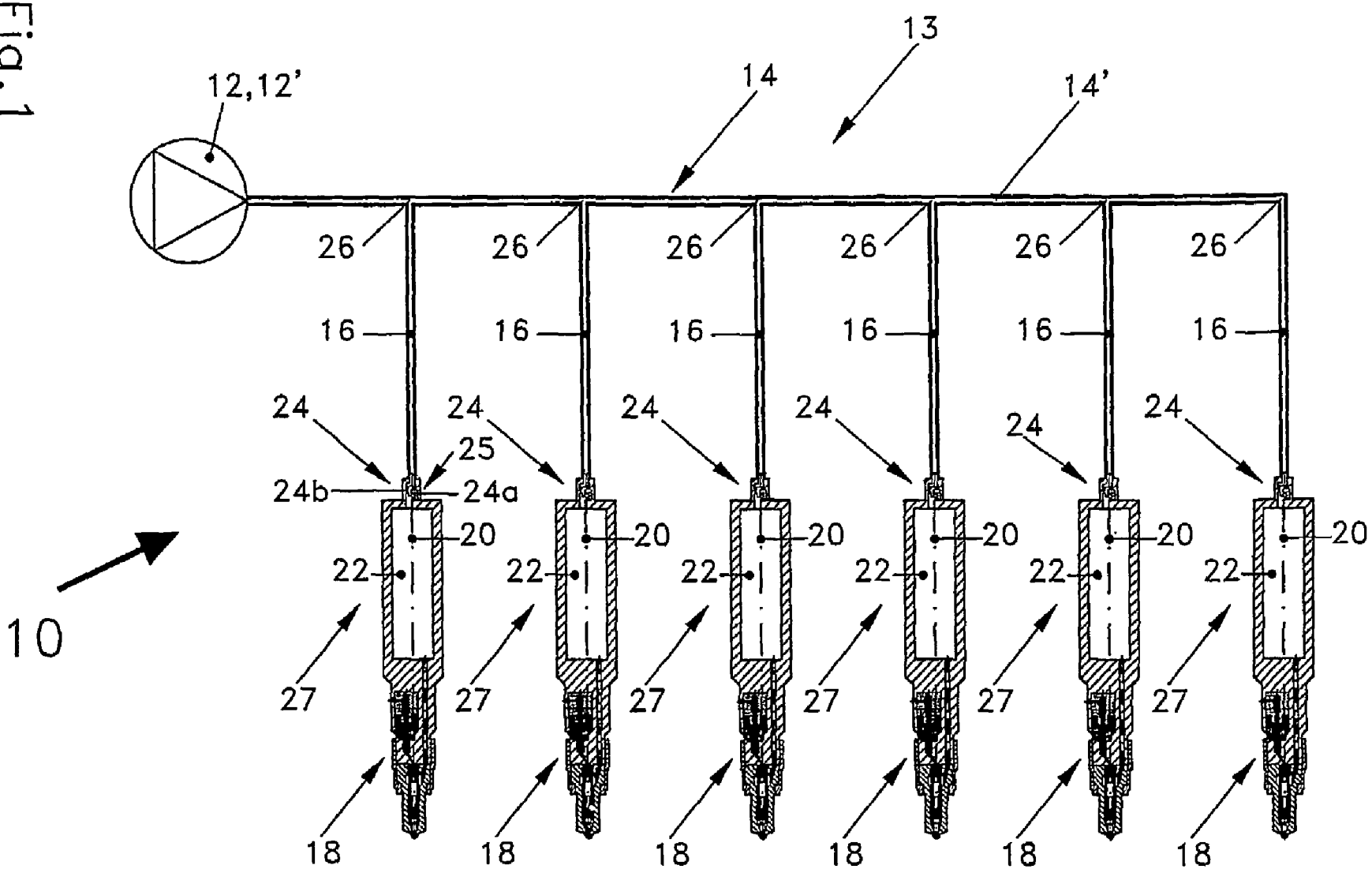

FIG. 1 shows an accumulator injection system 10, in which a high-pressure conveying device 12 is illustrated diagrammatically. As a rule, the high-pressure conveying device 12 is a high-pressure pump 12' which is driven mechanically and with a fixed rotational speed ratio by the internal combustion engine. A high-pressure compensation volume and, additionally, a pressure sensor for detecting and regulating the system high pressure may be located within the high-pressure pump 12', as is not illustrated in FIG. 1. The high-pressure pump 12' or high-pressure conveying device 12 is followed on the outlet side by a high-pressure line system, as a rule fastened by means of a high-pressure screw connection. The line system constructed from hydraulic line means 13 consists of a fuel feed line 14 extending in the longitudinal direction (and normally consisting of a plurality of line pieces 14' assembled in the longitudinal direction) and in each case of a fuel line 16 per injection valve 18, a total of six such fuel lines being present. The accumulator injection system 10 illustrated is therefore suitable for a six-cylinder engine. Engines other than six-cylinder engines may also be employed, which are used with all the possible customary numbers of cylinders. The six fuel lines 16 are flow-connected to the fuel feed line 14 at the branch points 26. Although the fuel feed line 14 and the fuel lines 16 of FIG. 1 are depicted with the same cross section, these cross sections may be of different size (the diameter of the fuel lines 16 may, for example, also be half the diameter of the fuel feed line 14). However, the overall volume of the fuel lines 14 and 16 is, in total, of too low an accumulator action to implement alone the required, reproducibly identical injection operations of the injection valves 18.

Figure 2:
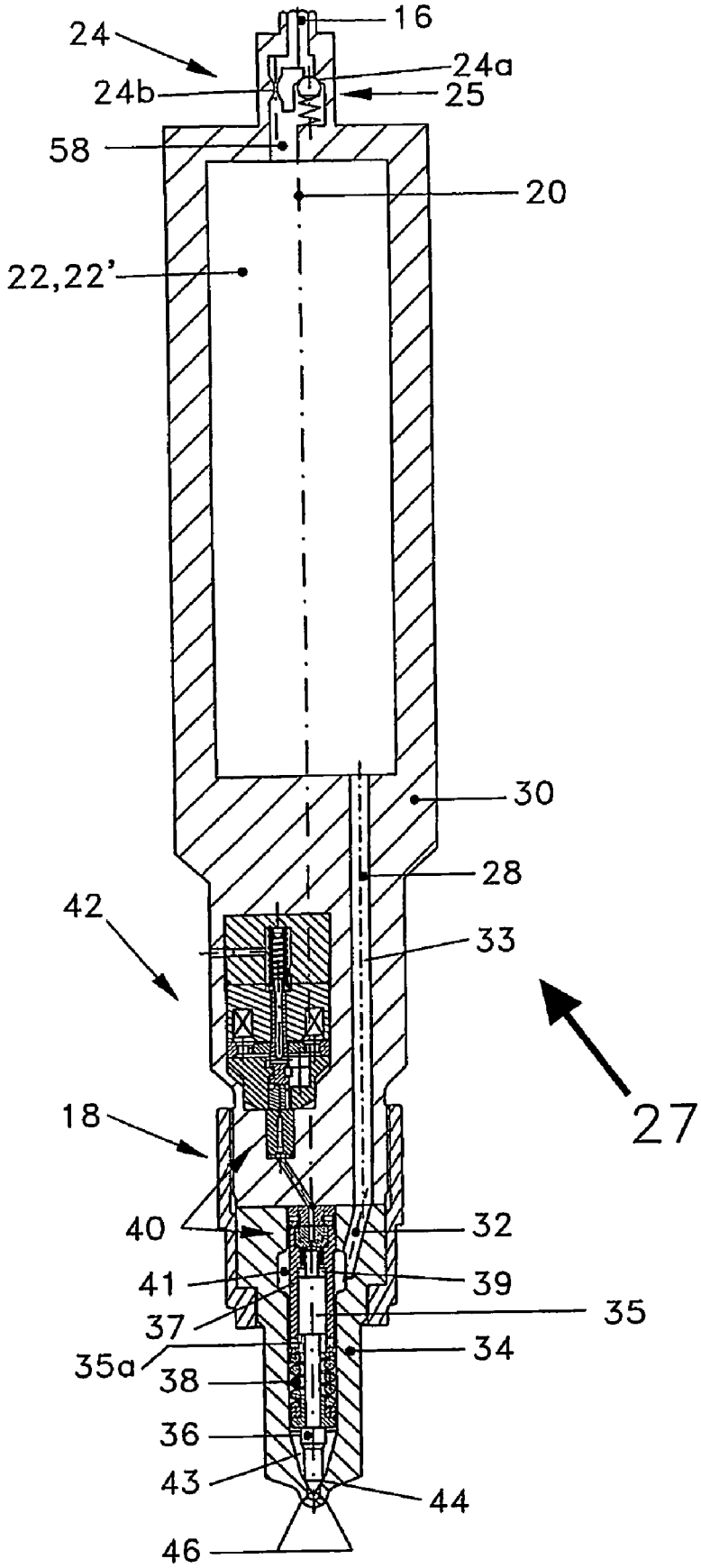

In each injection valve 18, in each case a fuel line 16 issues, in the direction of the longitudinal axis 20 of the respective injection valve, into an accumulator chamber 22 assigned to the injection valve 18 (see also FIG. 2). The fuel lines 16 could also issue laterally into the accumulator chambers 22. A one-way nonreturn valve 24*a*, with a parallel connection of a bypass throttle 24*b*, is arranged in the immediate vicinity of the accumulator chamber 22 between each fuel line 16 and each accumulator chamber 22. For simplification, this arrangement is called a nonreturn valve with bypass throttle 24, and it forms a throttling device 25. The nonreturn valve with bypass throttle 24 could also be arranged anywhere in the fuel line 16 between the associated accumulator chamber 22 and the branch point 26 or could also be integrated into the branch point 26 which may be designed as a hydraulic T-piece with screw connections. In this case, the flow direction for the nonreturn valve with bypass throttle 24 plays an important part, and, above all, the fact that each injection valve 18 is assigned both a nonreturn valve with bypass throttle 24 and an accumulator chamber 22. Each injection valve 18 with the assigned accumulator chamber 22 and with the assigned nonreturn valve with bypass throttle 24 forms an injection unit 27.

The description of the embodiments shown in FIGS. 2-10 employs the same reference symbols for the corresponding parts as, further above, in connection with the description of the accumulator injection system 10 shown in FIG. 1. Further, only the differences from the accumulator injection system 10 shown in FIG. 1 or from exemplary embodiments already described previously are presented below.

In the longitudinal section of the injection valve 18 of FIG. 2, a bore 28 in an injection valve housing 30, in which the accumulator chamber 22 is also formed, connects the accumulator chamber 22 to a further bore 32 in a nozzle 34 of the injection valve 18. The bore 28 and the further bore 32 form a connecting duct 33. Furthermore, the injection valve 18 possesses an injection valve member 36 with a control piston 35, the underside of which is designated by 35*a*, a guide sleeve 37 for the injection valve member 36, an injection valve member spring 38, a control space 39, a hydraulic control device 40, a nozzle prespace 41 into which the connecting duct 33 issues, and a solenoid valve actuator arrangement 42 (this could also be a piezoactuator).

The functioning of the injection valve 18 is summarized as follows: current is applied to the actuator arrangement 42 and the hydraulic control device 40 responds. This causes a movement of the injection valve member 36 away from a nozzle seat 44 of the nozzle 34, with the result that fuel under high pressure flows from the accumulator chamber 22 via the bore 28 and the further bore 32 to the nozzle injection orifices 46 of the nozzle 34 and the injection operation commences. When the current is removed from the actuator arrangement 42, the injection valve member 36 moves in the direction of the nozzle seat 44 via the hydraulic control device 40, until the injection operation is interrupted. For the exact description of the set-up and of functioning, reference is made to the prior art, for example to CH patent application 00676/05 and the corresponding WO application PCT/CH2006/000191 which describe this part of the injection valve 18 exactly. The actuator arrangement 42, shown to be offset axially with respect to the longitudinal axis 20, could also be arranged on the longitudinal axis 20.

The underside 35*a* of the control piston 35 of the injection valve member 36, the guide sleeve 37 and the control space 39 are located below the accumulator chamber 22. The accumulator chamber 22 of the injection valve 18 is hydraulically connected, virtually without resistance, to the nozzle prespace 41 via the bore 28 and a further bore 32. The passages, not shown in detail (for details, reference is made once again to CH patent application 00676/05 and WO application PCT/CH2006/000191), for the flow of fuel from the nozzle prespace 41 to the region 43 directly upstream of the nozzle seat 44 are also dimensioned such that as low a pressure drop as possible occurs between the nozzle prespace 41 and the region 43 during the injection operation.

Reference is made purely illustratively to the volume capacity of the accumulator chamber 22 which, in the injection unit 27 according to FIGS. 1 and 2, designed for an engine full-load injection quantity of 2500 $mm^3$ per injection, may amount to between 50 and 100 $cm^3$. As a comparison, in an injection system, such as is described in the specialist article "Das Akkumulator-Common-Rail-Einspritzsystem für die MTU-Baureihe 8000 mit 1800 bar Systemdruck" ["The accumulator common-rail injection system for the MTU construction series 8000 with a system pressure of 1800 bar"], with a full-load injection quantity of 3300 $mm^3$ per injection, an individual accumulator of 400 $cm^3$ is used, that is to say a 3 to 6 times larger accumulator. It is clear that it is substantially simpler to integrate an accumulator, such as that for the injection valve 18, into the injection valve housing 30.

During each injection of an injection valve 18, the high-pressure fuel from the fuel line 16 flows through the accumulator chamber 22, in order to arrive via the bore 28 and the further bore 32 at the nozzle prespace 41 and consequently at the nozzle 34. The fuel stream flows through the accumulator chamber 22 which is therefore a throughflow accumulator chamber 22'. Purely illustratively, the diameters of the fuel lines 14 and 16 (FIG. 1), once again designed for a full-load injection quantity of 2500 $mm^3$ per injection, may amount to between 3 and 9 mm, for example 6 mm.

Figure 3:
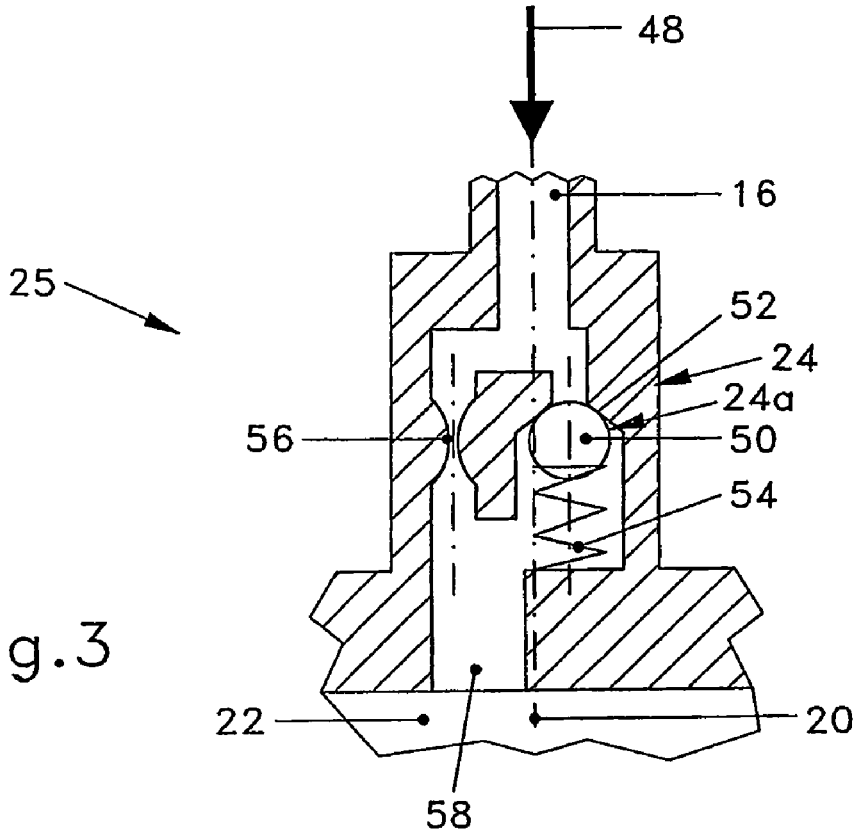
FIG. 3 shows a partial sectional illustration, further enlarged, as compared with FIG. 2, of the nonreturn valve with a parallel connection of the bypass throttle.

According to FIG. 3, the nonreturn valve with bypass throttle 24 has the nonreturn valve 24*a* with a ball 50, with a nonreturn valve seat 52 and with a nonreturn valve spring 54, a bypass throttle 56 and also an inlet of the fuel line 16 and an outlet 58 into the accumulator chamber 22. In the position shown in FIG. 3, the ball 50 bears against the nonreturn valve seat 52; no throughflow through the nonreturn valve 24*a* takes place. 48 shows the flow direction of the high-pressure fuel when the injection valve member 36 of the injection valve 18 is open and the injection operation is taking place.

It is known that the kinetic energy of the flow through a throttle is largely lost and converted into heat, as is the case with the bypass throttle 56. The bypass throttle 56 has an effective flow cross section which is preferably somewhat smaller than the overall effective flow cross section of the nozzle injection orifices 46 (the design range is between 0.3 and 3 times, depending on the specific version and on the number of injection valves 18 of the injection system 10). The nonreturn valve spring 54 is preferably not very strong and allows an opening of the nonreturn valve 24*a*, that is to say the movement of the ball 50 in the flow direction 48 away from the nonreturn valve seat 52, in the case of a pressure difference of, for example, 20 bar (the design range is between about 2 bar and somewhat above 50 bar, depending on the prestress of the spring 54).

In an alternative design variant of the accumulator injection system 10 of FIG. 1, the fuel lines 16 to the injection units 27 are omitted, and the fuel line pieces 14' are arranged such that they connect to the injection units 18 in series. This may be implemented such that a T-piece with an integrated nonreturn valve with bypass throttle 24 connects a first line piece 14', which leads to the side of the high-pressure pump 12', to a second line piece 14', which leads to the next injection valve 18, and the third T-junction leads via the nonreturn valve with bypass throttle 24 to the accumulator chamber 22 of the injection valve 18. At the last injection valve 18 of this chain, the free line junction either is blind or else is led back to the high-pressure pump 12' or to the first injection valve 18 of the series. In this last instance, a continuous arrangement of the line pieces 14' which is similar to the shape of a circle is obtained. The line pieces 14' may be straight or curved and of equal or unequal length, an arrangement in which the length of the line pieces 14' is equal or is only slightly unequal mostly being expedient.

The functioning of the fuel accumulator injection system 10 of FIG. 1, together with the injection valves 18 according to FIG. 2, the nonreturn valve with bypass throttle 24 according to FIG. 3 and the accumulator chamber 22 is as follows:

At the commencement of the injection operation, with the nonreturn valve 24*a* initially being closed, fuel flows out of the accumulator chamber 22 through the bore 28 and a further bore 32 and is injected through the nozzle injection orifices 46 into the combustion space of the internal combustion engine (the combustion space and internal combustion engine are not shown). As a result, the fuel expands, along with a slight pressure drop, in the accumulator chamber 22. The bypass throttle 56 cannot continue to convey sufficient fuel, thus causing the ball 50 to lift off from the nonreturn valve seat 52 in the direction of the flow 48, with the result that the follow-up of fuel from the fuel line 16 into the accumulator chamber 22 through which the fuel flows commences. This operation causes a dynamic lowering of pressure in the fuel line 16 which is propagated at sound velocity into the fuel line system. As the injection operation continues, the pressure in the accumulator chamber 22 falls further. On account of the reduced dimensions of the accumulator chamber 22, this lowering of pressure may amount, in the case of an initial pressure of, for example, 1600 bar, to up to a few hundred bar (for example, 100-400 bar), and, in turn, it is propagated dynamically into the fuel line 16 and into the fuel line system. Since the fuel line 16 communicates with the accumulator chamber 22 via the open nonreturn valve 24*a*, however, the lowering of pressure in the accumulator chamber 22 is smaller than if, with the same accumulator chamber volume, only the bypass throttle 56 were connected between, that is to say smaller than, for example, in an injection system according to DE 32 27 742. Furthermore, since the accumulator chamber 22 is advanced near to the nozzle seat 44, but, by means of the bore 28 and the further bore 32, above the control piston 35 of the injection valve member 36, the amplitude of the dynamic lowering of pressure in the fuel line 16 is smaller than in an injection system disclosed in EP 0 264 640 A, where there is no accumulator chamber 22 assigned to each injection valve 18.

During an injection operation which corresponds to a full-load injection of the associated internal combustion engine, the pressure lowering phase in the accumulator chamber 22 lasts for up to about half the overall injection duration. This value is purely indicative and may vary upward or downward, depending on the application. The dynamic lowering of pressure in the fuel line 16 then also covers the fuel feed line 14, the fuel lines 16 of the other, in particular adjacent fuel injection valves 18 and, via the bypass throttles 56, also the respective accumulator chambers 22. All these elements with high-pressure fuel have an accumulator action. However, the flow direction from the accumulator chambers 22 of the adjacent and, at most, further fuel injection valves 18 is opposite to the flow direction 48 of the injection valve 18 where injection takes place. Consequently, the nonreturn valves 52 of the adjacent and, at most, further injection valves 18 remain closed, and the follow-up of fuel from the assigned accumulator chambers 22 takes place solely through the bypass throttles 56, which, in the adjacent, and at most, further accumulator chambers 22, causes only a lower pressure drop than in the accumulator chamber 22 of the injection valve 18 which is just operating.

However, since there can be a high-pressure fuel follow-up from a plurality of accumulator chambers 22 via their bypass throttles 56, the overall fuel follow-up, taking place in the accumulator injection system 10, in the fuel line 16 and in the accumulator chamber 22 of the injecting injection valve 18 causes an advantageous recovery of the injection pressure in the second half of the injection operation, this recovery continuing up to the end of the full-load injection duration. The injection pressure in this phase rises at the nozzle injection orifices 46 and reaches a desirably high value toward the end of the injection operation; see, in this respect, also FIG. 13 along with the accompanying description.

If, then, the injection operation is ended rapidly, a dynamic pressure rise takes place in the bore 28 and the further bore 32 on account of the abrupt braking of the liquid column at the nozzle seat 44. This dynamic pressure rise is propagated as far as the assigned accumulator chamber 22 and is damped by the accumulator chamber volume. Furthermore, the remaining pressure rise can be propagated, likewise only damped, from the accumulator chamber 22 via the bypass throttle 56, and opposite to the flow direction 48, in the remaining part of the accumulator injection system 10, since the nonreturn valve 52 does not allow a throughflow opposite the flow direction 48. The bypass throttle 56 nullifies a substantial part of the energy carried along by the flow through the bypass throttle 56 and does not allow the occurrence in the accumulator injection system 10 of any pressure amplitudes which are difficult to control.

The arrangement of the nonreturn valve with bypass throttle 24 of the accumulator injection system 10 of FIG. 1 and of the injection valve 18 with accumulator chamber 22 of FIG. 2 therefore has the following advantages:

it damps the pressure fluctuation in the accumulator chambers 22 of noninjecting fuel injection valves 18 during the injection of any desired injection valve 18, it damps the pressure fluctuation between the injecting injection valve 18 and the rest of the accumulator injection system 10 at the end of injection, and it brings about an advantageously rising characteristic of the injection pressure in the second half of a full-load injection operation of any desired injection valve 18.

After the end of any injection operation, in the accumulator injection system 10 pressure differences remain in the accumulator chambers 22 and residual oscillations remain in the fuel feedline 14 and fuel lines 16. By virtue of a suitable design of the volume of the accumulator chambers 22, the properties of the nonreturn valves with the bypass throttles 24 (as mentioned above) and of the fuel feed line 14 and fuel lines 16 of a specific injection system 10, a virtually identical wave pattern ever-recurring for all the injection valves 18 is generated in it, so that all the injection valves 18 of the injection system 10 acquire virtually identical conditions for injection in terms of the pressure profile (see, in this respect, FIG. 11). This allows the arrangement of a number of injection valves 18 in the accumulator injection system 10 with the simple arrangement of FIG. 1, normally up to 8 injection valves 18 and, in some instances, more than this. The complicated and costly common rail is replaced by simple hydraulic line means 13—fuel feed line 14 and fuel lines 16. These may all have essentially the same throughflow cross section.

Figure 4:
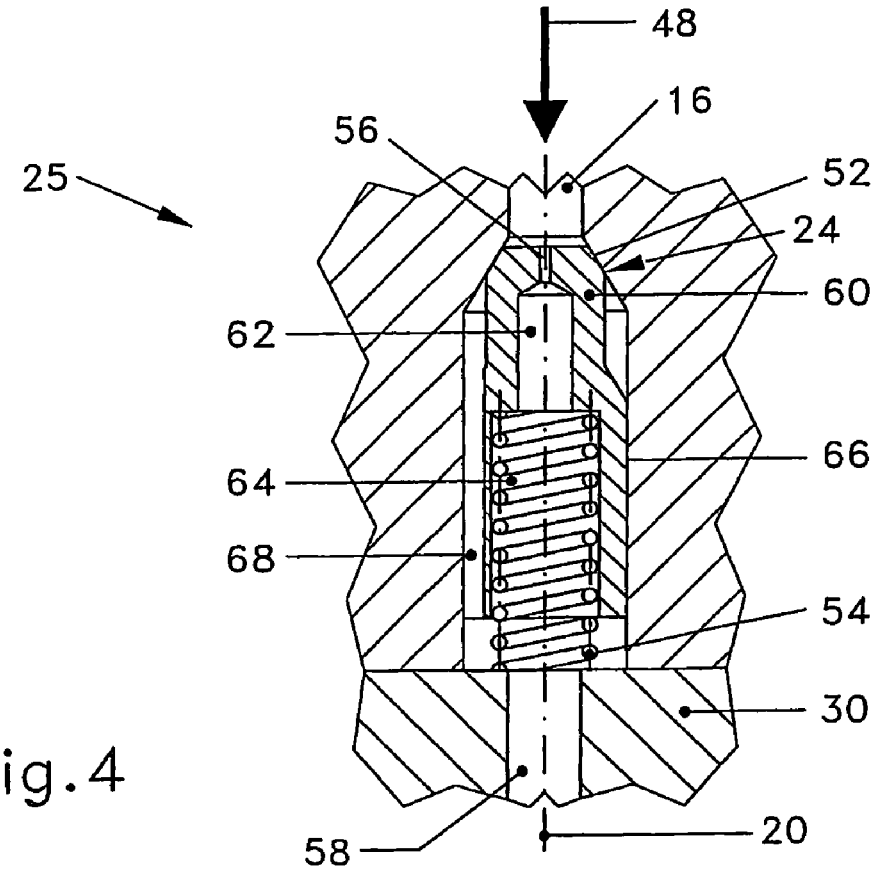
FIG. 4 shows a sectional drawing of a different embodiment of the nonreturn valve with a parallel connection of the bypass throttle, where the bypass throttle is produced in the body of the nonreturn valve.

FIG. 4 shows another design of the nonreturn valve with bypass throttle 24 which is assigned to each injection valve 18. In this version, a needle-shaped closing member 60 cooperates with the nonreturn valve seat 52. The closing member 60 has on the end face and in the direction of the longitudinal axis 20 the bypass throttle 56 which opens into a bore 62 and subsequently into a clearance 64 in the closing member 60. The clearance 64 receives the nonreturn valve spring 54. The needle-shaped closing member 60 has radially on the outside a guide 66 which guides the closing member 60 in an operationally reliable way, and, furthermore, at least one passage 68 on the circumference of the closing member 60 (there may even be two or three passages 68). The overall cross section of the passage 68 is sufficiently large to present only very low flow resistance. The operation of this throttling device 25 is the same as that according to FIG. 3. In all the exemplary embodiments, the nonreturn valve with bypass throttle may be designed according to FIG. 4.

Figure 5:
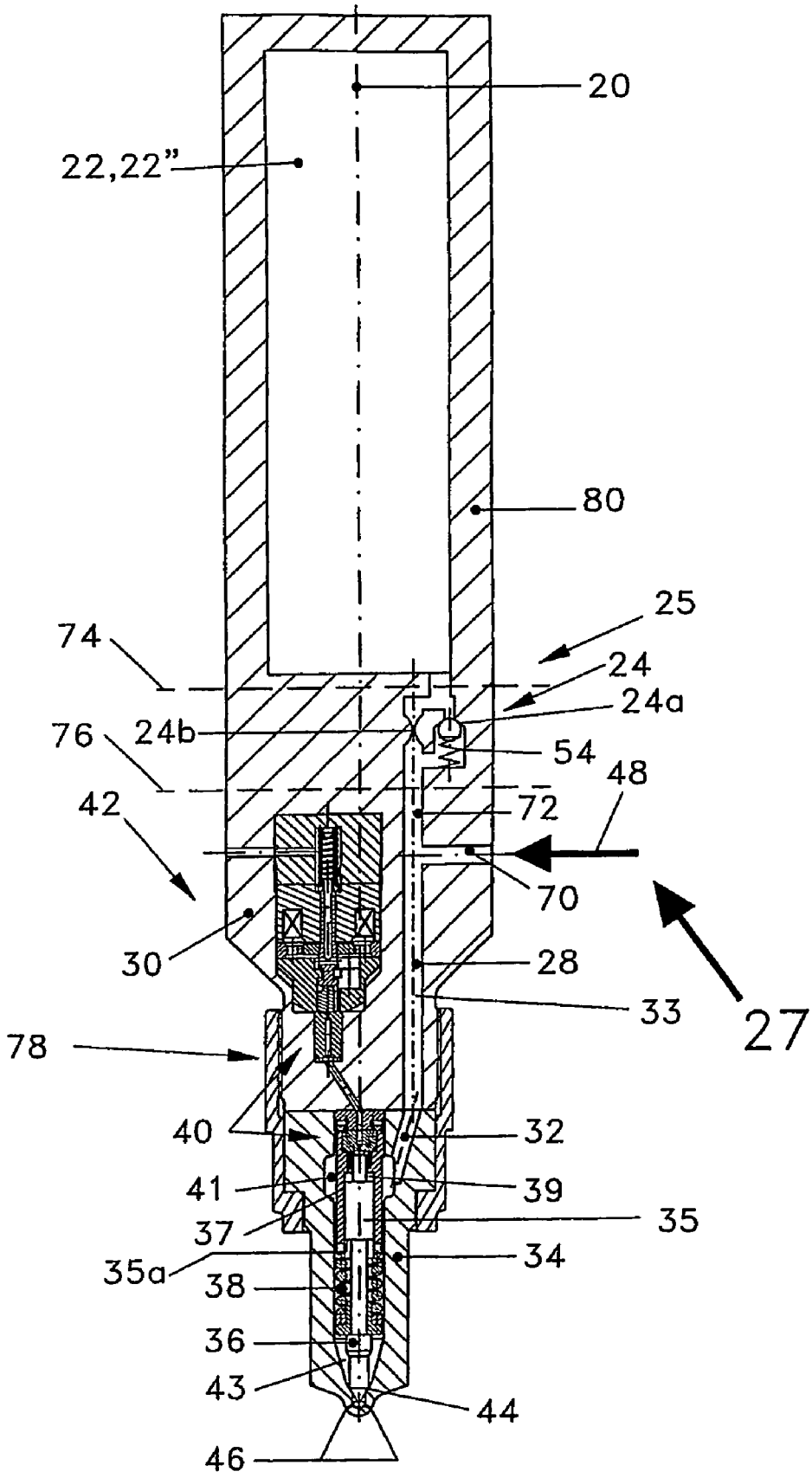
FIG. 5 shows, in an identical illustration to FIG. 2, a second embodiment of the injection unit with an arrangement of the nonreturn valve with bypass throttle between the accumulator chamber and injection valve, above the high-pressure inflow, the high-pressure inflow being arranged laterally, and a fuel not flowing through the accumulator chamber (=cul-de-sac accumulator chamber)

In FIG. 5, the nonreturn valve with bypass throttle 24, assigned to the injection valve 78, is located between the accumulator chamber 22 and the nozzle 34, the high-pressure inflow 70 to the injection valve 78 being arranged laterally in the injection valve housing 30 below the nonreturn valve with bypass throttle 24. The high-pressure inflow 70 connected to the fuel line 16 branches downward into the bore 28 and upward into the short bore 72 which leads to the nonreturn valve with bypass throttle 24. The nonreturn valve with bypass throttle 24 is therefore arranged in the connecting duct 33 which, by means of the bores 28, 32 and 72, connects the accumulator space 22 to the injection valve 78. The high-pressure inflow 70 could also run vertically and parallel to the longitudinal axis 20 or at an angle to this. It is important, in this example, that the nonreturn valve with bypass throttle 24 is located between the high-pressure inflow 70 and the accumulator chamber 22. As a result, the fuel does not flow through the accumulator chamber 22 of the injection valve 78 during an injection operation, and said accumulator chamber empties partially into the bore 72. The accumulator chamber 22 acting as a cul-de-sac accumulator chamber 22" is located above the control piston 35 of the injection valve member 36 and, here too, precedes these elements.

This arrangement leads to a different behavior of the injection valve 78 in the overall accumulator injection system 10, as compared with the injection unit 27 according to FIG. 2, specifically as follows:

At the commencement of the injection operation, the fuel will flow for the most part out of the fuel line 16 through the bores 70, 28 and 32 to the nozzle injection orifices 46. It can be determined from the design of the cross section of the bypass throttle 56 and the force of the spring 54 (see FIG. 3) how much fuel flows proportionately from the accumulator chamber 22 to the nozzle injection orifices 46 at the commencement of injection and when the nonreturn valve 52 opens. Up to about half of a full-load injection operation, the conditions are otherwise similar to those of the arrangement according to FIGS. 1 and 2.

If, then, the dynamic lowering of pressure in an injection valve 78 arrives via the fuel feedline 14 and fuel line 16 at the nonreturn valve with bypass throttle 24 of an adjacent injection valve 78, the nonreturn valve 24*a* of the latter may also open and, in addition to the assigned bypass throttle 56, follow up with fuel from the accumulator chamber 22 dynamically to the injecting injection unit 27. If the dynamic pressure recovery wave arrives at the injecting injection valve 78, the nonreturn valve 24*a* of this injecting injection valve 78 will then, when the pressure recovery wave reaches the closing side of the nonreturn valve 24*a*, shut off the passage of the pressure recovery wave to the accumulator chamber 22 of this injecting injection valve 78, and therefore almost the entire pressure wave amplitude arrives, virtually undamped, as a pressure rise at the nozzle injection orifices 46 (reduced by the amount of that fraction which can pass via the bypass throttle 24*b* into the accumulator chamber 22 of this injecting injection valve 78).

The different switching behavior of the nonreturn valves 24*a* in the second half of the injection operation, as compared with the arrangement of FIG. 2, constitutes a first essential difference. This dynamic process may bring about a stronger pressure recovery in the second half of the full-load injection operation than in the arrangement according to FIGS. 1 and 2.

This arrangement is highly effective even with only two injection valves 78 having two assigned accumulator chambers 22, two assigned nonreturn valves with bypass throttles 24 and the associated fuel feed and fuel lines 14, 16. In fuel injection systems 10 with more than two injection valves 78, an additional reduction in the overall volume of accumulated high-pressure fuel can be achieved, as compared with the arrangement of FIGS. 1 and 2. The arrangement of the nonreturn valve with bypass throttle 24 of the injection valve 78 of FIG. 5 therefore affords more advantages than that according to FIGS. 1 and 2 in terms of the dynamic pressure recovery wave in the second part of the injection operation.

The second essential difference from the arrangement of FIG. 2 is that the fuel does not flow through the accumulator chamber 22, which therefore acts as a cul-de-sac accumulator chamber 22". If the injection operation is ended quickly, once again, a dynamic pressure rise takes place in the bores 28 and 32 on account of the abrupt braking of the liquid column at the nozzle seat 44. This dynamic pressure rise is propagated into the line system to a greater extent than in the arrangement of FIGS. 1 and 2, since it can arrive only via the bypass throttle 56 at the accumulator chamber 22 of the injection valve 78 which has just ended the injection operation, and, consequently, this dynamic pressure rise does not flow through the accumulator chamber volume and the pressure rise is damped to a lesser extent.

In a design variant, not shown, of an injection valve according to the present invention, the injection valve has a cul-de-sac accumulator chamber 22", and the nonreturn valve with bypass throttle 24 is located at the inlet of the lateral high-pressure inflow 70 of the injection valve. This version has virtually the same behavior as the injection valve 18 of FIG. 2.

A first separating line 74, shown by a line of dashes in FIG. 5, relates to a first alternative embodiment, in which the accumulator chamber 22 with its own accumulator chamber housing 80 is to be understood as being a unit separate from the injection valve 78. The accumulator chamber housing 80 is then connected either to a short line or, by means of a screw connection, to the injection valve housing 30, but in any event remains assigned to the injection valve 78. The nonreturn valve with bypass throttle 24 continues to be arranged in the segment of the connecting duct 33 of the injection valve housing 30. A second separating line 76 shows a second alternative embodiment, in which the nonreturn valve with bypass throttle 24 is integrated in the accumulator chamber housing 80. In this second alternative, too, the connection to the injection valve housing 30 may be made either by means of a short line or by means of a screw connection, and assignment to the injection valve 78 is maintained. These alternative embodiments allow a greater latitude of configuration and may also be adopted in the injection valve 18 (FIG. 1) and in the injection valve 88 described further below (FIG. 6) and likewise in the variant with a series connection between the line pieces 14', together with the injection valves 18, 78 and 88.

In a further alternative embodiment, not shown, of the injection valves 18, 78, 88, the accumulator chamber 22 is arranged laterally, either offset axially parallel to the longitudinal axis 20 or at an angle (of, for example, 90°) to the longitudinal axis 20. Here, too, the housing of the accumulator chamber 22 may be formed in one piece with the injection valve housing 30 (for example, this structural unit is produced as a forging) or as two components screwed to one another.

Figure 6:
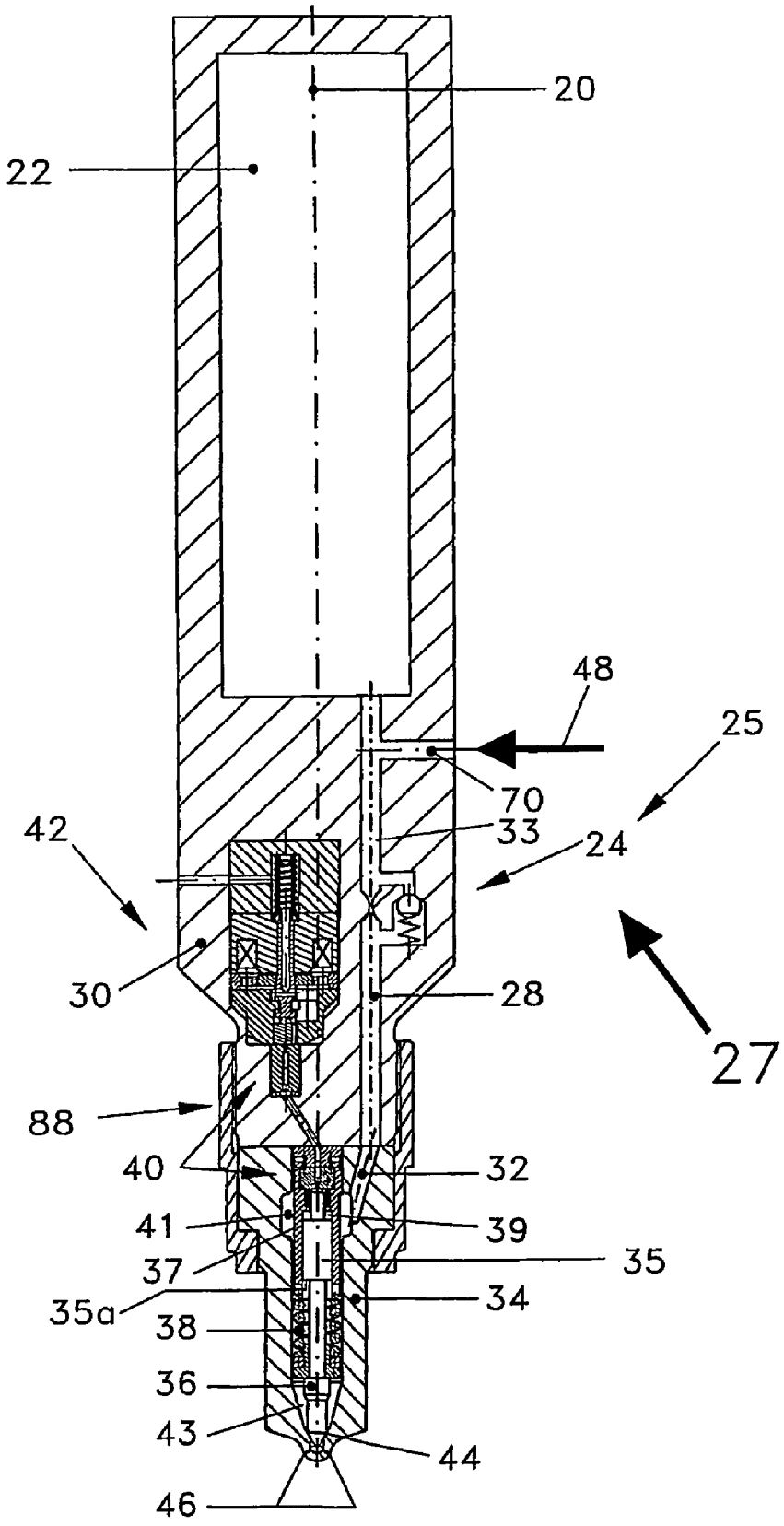
FIG. 6 shows, in an identical illustration to FIGS. 2 and 5, a third embodiment of the injection unit with an arrangement of the nonreturn valve with bypass throttle between the accumulator chamber and injection valve below the high-pressure inflow, the accumulator chamber of the injection valve being a cul-de-sac accumulator chamber (through which the fuel does not flow)

In FIG. 6, the nonreturn valve with bypass throttle 24 of the injection valve 88 is located in the connecting duct 33 between the accumulator chamber 22 and the nozzle 34, below the lateral high-pressure inflow 70. The injection unit 27 according to FIG. 6 is otherwise designed identically to that according to FIG. 5. Here, the high-pressure fuel can circulate, unimpeded, via the fuel feedline 14 and fuel lines 16 in all the accumulator chambers 22 of the accumulator injection system 10, the inflow and return flow to and from the nozzle 34 being controlled by the nonreturn valve with bypass throttle 24. In the first and the second part of a full-load injection operation, the injection profile illustrates a mixed form of this, this being the case in the accumulation injection system 10 when the injection valves 18 or 78 are used. The advantage of this arrangement is the particularly short travel distance of small volume between the nozzle injection orifices 46 and the nonreturn valve with bypass throttle 24. As a result, the overpressure oscillation which occurs during the rapid ending of the injection operation and which has a high oscillation frequency is damped very quickly.

However, in an accumulator injection system 10 with the design of the injection units 27 according to FIG. 6, particular attention must be devoted to the ripple of the dynamic pressure oscillations which have a lower oscillation frequency, since these pressure oscillations between the accumulator chambers 22 of the accumulator injection system 10 are damped to only a slight extent and may lead to overly unequal injection operations of the injectors 88. The arrangement of the nonreturn valve with bypass throttle 24 of the injection valve 88 may present problems in the case of more than four injectors 88 connected, undamped, to one another. Solutions to this problem are described in connection with the accumulator injection system 90 according to FIG. 7 and FIGS. 8 and 9.

Figure 7:
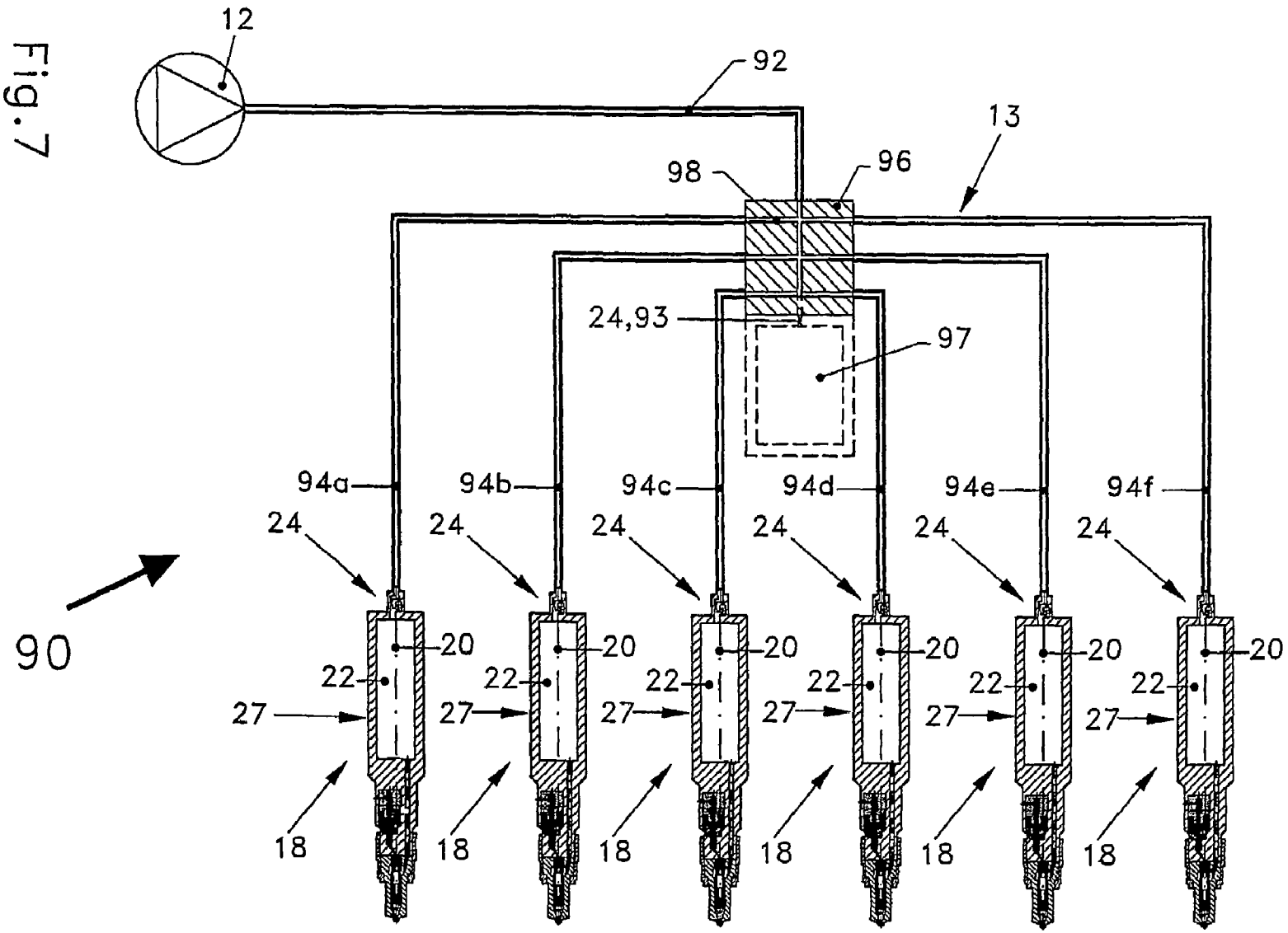
FIG. 7 shows, in an identical illustration to FIG. 1, a variant of the accumulator injection system, the line means having a distributor block.

In the embodiment, shown in FIG. 7, of the accumulator injection system 90 according to the invention, the high-pressure conveying device 12 and the injection valve units 27 are designed as disclosed in connection with FIGS. 1 and 2. However, the hydraulic line means 13 have a distributor block 96, to which the fuel feedline 92 and all the fuel lines 94*a* to 94*f* are led and are connected, for example by means of high-pressure screw connections (not shown in detail). The distributor block 96 is provided with bores 98 which connect the fuel feedline 92 and all the fuel lines 94*a* to 94*f* to one another hydraulically. In the arrangement of FIG. 7 with six injection valves 18, the fuel lines 94*a* and 94*f*, 94*b* and 94*e* and also 94*c* and 94*d* are illustrated in pairs with equal length. Alternatively, all the fuel lines 94*a* to 94*f* may be designed with the same length, so that the wave transit times from each injection valve 18 to the distributor block 96 last for the same length of time. Even different line lengths which are not identical in pairs may be envisaged. The advantage of the arrangement with a distributor block 96 is that the latter is in a central position which combines all the high-pressure screw connections in this distributor block 96. Here, too, the line means 13 have too low an accumulator action to make it possible alone to have the required, reproducibly identical injection operations of the injection valves.

For the sake of completeness, it may be mentioned that even injection units, such as those shown in FIGS. 5 and 6, may be used in the accumulator injection system 90, and this also applies to the accumulator injection system 10.

In a design variant, the distributor block 96 is assigned an accumulator chamber 97, as indicated in FIG. 7 by dashed lines. This accumulator chamber 97 preferably has about the same volume as each of the accumulator chambers 22. However, the volume may even be larger, for example twice to six times as large. This is a single additional accumulator chamber 97. If the accumulator chamber 97 is connected to the distributor block 96 by means of a throttle 93 or else by means of a nonreturn valve with bypass throttle 24, this accumulator chamber 97 can firstly influence the individual injection operations positively, and, secondly, advantageously damp the ripple of those dynamic pressure oscillations which have a lower oscillation frequency, thus having a positive effect mainly when injection units 88 according to FIG. 6 are used. The disadvantage is the additional outlay in terms of the construction of the accumulator chamber 97.

Figure 8:
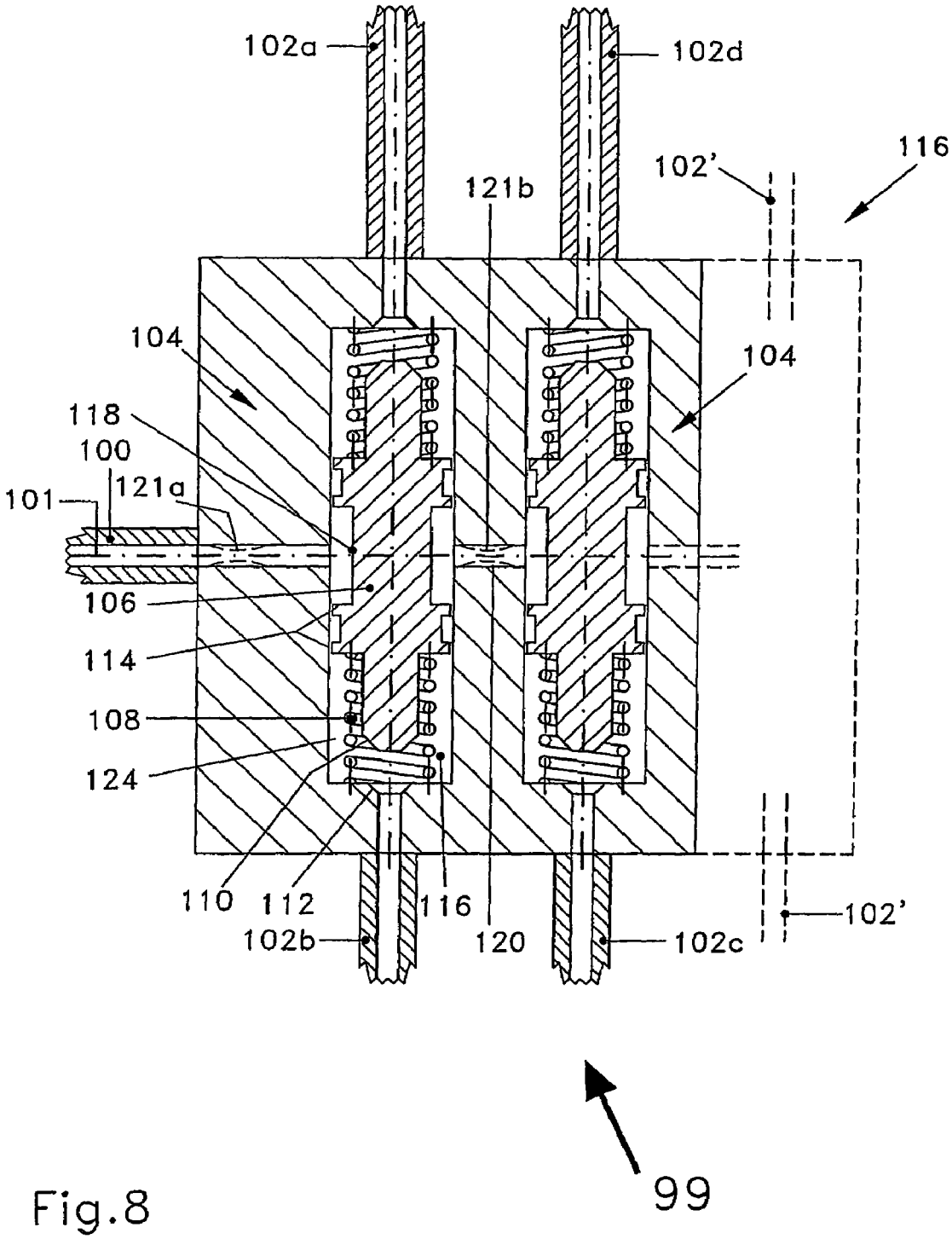
FIG. 8 shows an alternative design, illustrated enlarged, as compared with FIG. 7, of the distributor block with double-acting overload throughflow limiting valves.

FIG. 8 shows a design of the distributor block 99 which is equipped with double-acting overload throughflow limiting valves 104. Throughflow limiting valves are disclosed, for example, in the publication SAE Paper 910 184 (1991). Their purpose is to protect the internal combustion engine against an overload in the event that the injection valve member of an injection valve unintentionally remains open for too long a time.

The high-pressure fuel passes via the fuel feedline 100 into a distributor block 99 symmetrical to an axis 101 and, via fuel lines 102*a*, 102*b*, 102*c* and 102*d*, to four injection units 27. Further possible fuel lines in the case of an extension, shown by dashes at 116, of the distributor block 99 are indicated by dashes at 102'. The valve body 106 of each throughflow limiting valve 104 is of double-acting design. During each injection operation, the valve body 106 moves in the direction of the fuel line 102 which leads to the injection unit 27 having the injecting injection valve. When the accumulator injection system 90 is functioning normally, the valve body 106 does not move so far that the conical end 110 reaches as far as the shut-off seat 112. In the intermissions between injection operations, the valve body 106 is brought into its central position of rest by the force of a spring 108. By contrast, if too much fuel is unintentionally demanded if an injection operation lasts for too long a time, the conical end 110 reaches the shut-off seat 112 and closes off the further flow of fuel. Slightly throttling annular passage surfaces between the valve body 106 and the body of the distributor block 99 are designated by 114. They lie between the fuel inlet through the fuel feedline 100 and a prespace 116 to a fuel line 102. Furthermore, the valve bodies 106 have in the middle a narrowed region 118, in order to ensure the unimpeded throughflow of fuel from the fuel line 100 and through a bore 120 to all the throughflow limiting valves 104.

The advantage of this solution is that a double-acting throughflow limiting valve 104 serves at least two injection valves 18 and therefore the number of throughflow limiting valves 104 for a specific engine is at least halved, as compared with the prior art.

In design variants, a throttle 121*a* is arranged in the fuel inflow to the distributor block 99, as depicted by dashes. Instead of this throttle 121*a*, a throttle 121*b* may be present in the fuel inflow segment in each case between two chambers 124 receiving a double-acting throughflow limiting valve 104. It is also conceivable, however, to install both throttles 121*a* and 121*b*. Furthermore, the distributor block 99 may be assigned an accumulator chamber 97 in a similar way to the distributor block 96. The purpose of these elements is the same as was described in connection with the design variant of the distributor block 96. In this case, too, the outlay in structural terms increases.

Figure 9:
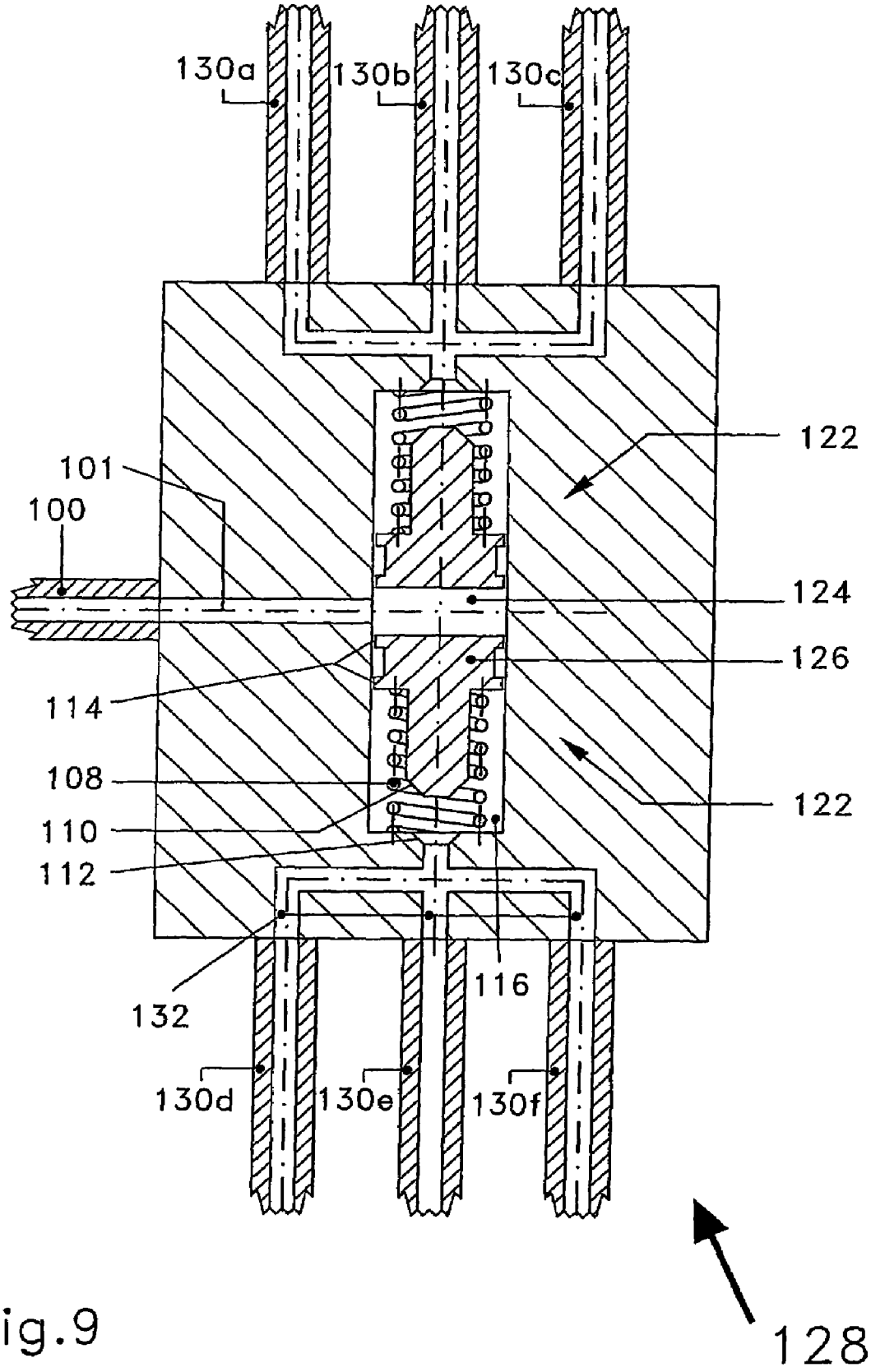
FIG. 9 shows, in an identical illustration to FIG. 8, a second alternative design of the distributor block with single-acting overload throughflow limiting valves.

FIG. 9 shows a further alternative design of the distributor block 128, again symmetrical to the axis 101, with two single-acting overload throughflow limiting valves 122. Only the lower part of the distributor block 128 which is symmetrically identical to the upper part is described. In a similar way to the example according to FIG. 8 described further above, the fuel in the chamber 124 flows via annular throughflow surfaces 114 to the prespace 116 and, from here, in each case into a passage 132 with three outlets for three fuel lines 130*d*, 130*e* and 130*f* which in each case lead to an injection unit 27. The two valve bodies 126 are single-acting here. In the case of an overly long injection duration, the conical end 110 of the respective valve body 126 will again come into the shut-off seat 112 and then interrupt the throughflow of fuel in the case of three injection units 27. The motor can then still be operated at reduced load, but three cylinders fail, instead of only one cylinder, as in the design of FIG. 8. Instead, the number of throughflow limiting valves is smaller.

Figure 10:
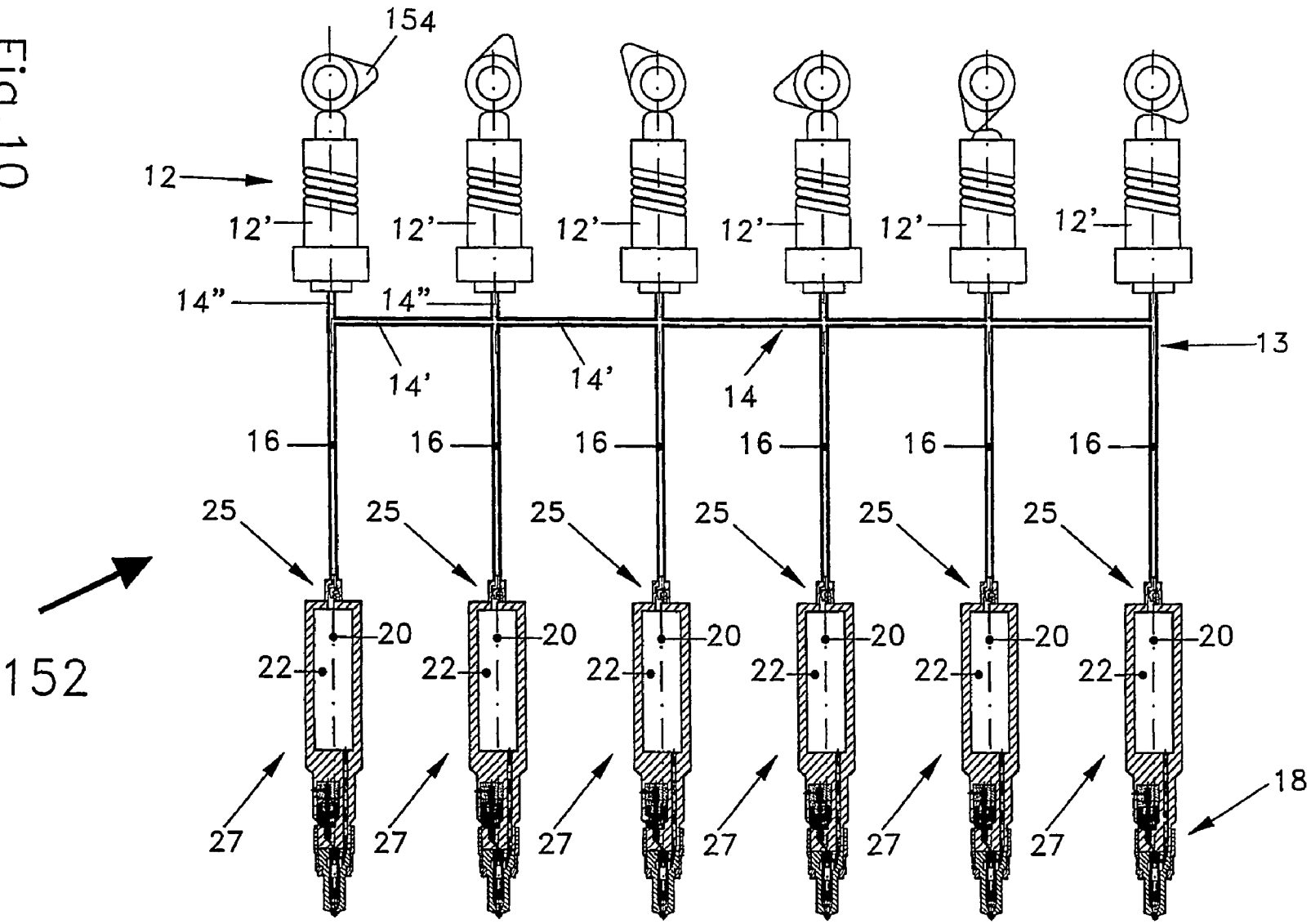
FIG. 10 shows, in an identical illustration to FIGS. 1 and 7, an embodiment of the accumulator injection system according to the invention with a high-pressure conveying pump per injection unit.

FIG. 10 shows a further embodiment of an accumulator injection system 152 according to the invention which is very similar to that according to FIG. 1. The only difference is that the high-pressure conveying device 12 has per injection unit 27 a high-pressure pump 12' which is connected in each case via a fuel pump line 14" to the fuel feedline 14 or to the line pieces 14'. Injection units 27 according to FIGS. 1 and 2 are shown. However, all the other embodiments described may also be used.

In the embodiment shown in FIG. 10, the high-pressure pumps 12' are equipped with short-conveying cams, as is customary in injection systems with a high-pressure conveying pump 12' per injection valve 18. It is also possible, however, to design the cams 154 as harmonic excentrics. If, as shown in FIG. 10, a short-conveying cam is used per injection unit 27, the selected volume of the accumulator chambers 22 of each injection unit 27 can be particularly small; a volume which is approximately 10 times as large as the injection quantity for a full-load injection operation may be sufficient, since the fuel-conveying pulse which is assigned to the injection valve 18 just injecting and which commences and takes place simultaneously with or shortly before the injection operation conveys a considerable fraction of the quantity to be injected, directly into the respective accumulator chamber 22. Preferably, the pumping operation of each high-pressure conveying pump 12' overlaps at least partially, preferably completely, with the injection operation of the assigned injection unit 27.

An accumulator injection system of this type is suitable particularly for a retrofit on an existing internal combustion engine, in which case the high-pressure pumps 12' of the original conventional injection system can be preserved and therefore only new injection units 27 and new hydraulic line means 13 have to be retrofitted.

In all the exemplary embodiments shown, the accumulator chambers 22 and the nonreturn valve with bypass throttle 24—the throttling device 25—and also the issue of the bore 32 are mounted above the underside 35*a* of the control piston 35 of the injection valve member 36, thus allowing a particularly compact configuration of the operating elements in the nozzle 34. The accumulator chamber 22 and/or the nonreturn valve with bypass throttle 24 may also be installed such that they are accommodated below the underside 35*a* of the control piston 35, in a similar way to known injection valve versions, and, if appropriate, allowing for a long injection valve member. The design could also be such that only the bore 32 issues below the underside 35*a* of the control piston 35 of the injection valve member 36.

In all the exemplary embodiments, the accumulator injection system has no accumulator space common to all the injection valves, in the manner of a common rail. This is reflected in that the hydraulic connection means of an accumulator injection system according to the invention have too a low an accumulator action to generate alone the required, reproducibly identical injection operations of the injection valves. The connection means may preferably all have at least approximately the same cross section. Any small chambers or spaces, such as are necessary, for example, for throughflow limiting valves, or any throttles are also to be included. It is important, however, that, during each full-load injection operation, fuel is also supplied from accumulator chambers other than the accumulator chamber assigned to the injection valve just injecting and from the high-pressure conveying device.

The throttling device 25 may also be designed, for example, in the form of a "hydraulic circular diode".

An accumulator injection system according to the invention preferably has at least three injection units 27.

For diesel engines with a performance of the order of 250 KW per cylinder, flow cross sections in the fuel line system corresponding to a diameter of about 6 mm are recommended. Diameters of 2-4 mm are recommended for performances of about 50-100 KW.

An accumulator injection system 10 according to the invention, as shown in FIG. 1, for an eight-cylinder diesel engine with a performance of 250 KW per cylinder was analyzed by means of computer-assisted simulation. The injection quantity per injection operation under full load was set at 2000 $mm^3$ and the diameter of the fuel feedline 14 and fuel lines 16 lay around 6 mm. The system high pressure lay around 1500 bar and each of the accumulator chambers 22 had an accumulator volume of 100 $cm^3$. The graphs of FIGS. 11, 13 and 15 show results of this simulation.

For comparison, an accumulator injection system with a common rail was also simulated. In this case, the exactly identical stipulations were taken into account. The only difference was that the fuel was supplied directly to the injection valves 18 by means of the fuel lines 16, and that a volume of 800 $cm^3$, corresponding to the eight accumulator chambers 22, was shifted into the line pieces 14' in the manner of a common rail, with their cross section being assumed to be enlarged correspondingly. The injection valves 18 were therefore not assigned any individual accumulator chamber 22 or any throttling device 25. Results of this simulation are shown in the graphs of FIGS. 12, 14 and 16.

In all the graphs, the abscissa is the time axis, the time being given in seconds. In FIG. 11 to 14 the pressure in units of 1000 bar and in FIGS. 15 and 16 the throughflow quantity of fuel in liters per minute are plotted on the ordinate.

FIG. 11 shows the pressure profiles in all eight injection units 27 at the issue of the bore 28 in the accumulator chamber 22 (see FIG. 2). The duration, a good five milliseconds long, of the injection operation of one of the injection valves 18 is designated by Te. The dashed line running in this interval downward to about 1400 bar and back upward again shows the pressure in the active injecting injection valve 18, whereas the superposition of the pressure profiles of the remaining seven injection valves 18 in this time interval forms the thick line lying at approximately 1500 bar. After this time interval Te, the pressure at the inlet of the injection valve 18 which has just ended the injection operation runs according to the dashed line running above the thick line. The eight successive injection operations of the eight injection valves 18 are shown correspondingly.

It may be gathered from FIG. 11 that approximately the same pressure conditions prevail for all the injection operations, and that, in a first part of an injection operation, during about half the time of Te, the pressure falls by about 100 bar and, in a second part of the injection operation, recovers again to about the original pressure of 1500 bar.

FIG. 12 shows, on the same scale, the pressure profiles at the same location—at the inlet of the bore 28—of each of the eight injection valves 18, but in the injection system with a common rail and without accumulator chambers 22 and throttling devices 25 assigned to the injection valves 18. As may easily be gathered from this, the pressure fluctuations at the inlet of the injection valves 18 are much greater and of much higher frequency than in the accumulator injection system 10 according to the invention. It can clearly be seen that the latter reliably ensures better injection conditions.

FIG. 13 shows the pressure profile of the injection valve 18 injecting during the time segment emphasized in FIG. 11 by Te, during a millisecond before the commencement of the injection operation, during the injection operation lasting a good five milliseconds and during exactly four milliseconds after the end of the injection operation. As also already stated further above in connection with the operating description of the accumulator injection system 10 according to FIGS. 1 and 2, during a first part of a full-load injection operation which lasts about half as long as the overall injection operation, the pressure at the inlet of the active injection valve 18 decreases, here by about 100 bar, and then increases again in the subsequent second part of the injection operation. This pressure increase is caused by the afterflow of fuel from other, in particular adjacent accumulator chambers 22 and the high-pressure conveying device 12. The pressure profile without the afterflow of fuel is indicated by the dashed straight line 156. The pressure gain up to the end of the injection operation therefore amounts, in the accumulator injection system 10 according to the invention, to a good 250 bar. The pressure profile following the time interval Te and having an oscillating pressure rise is caused by the abrupt stopping of the moved fuel column during the closing of the injection valve 18. The pressure very quickly becomes equal to the system high pressure of 1500 bar again.

FIG. 14 shows the pressure profile on the same injection valve 18 as shown in FIG. 13, but in the injection system with a common rail. The duration of the injection operation is emphasized once again by Te. The sharp and rapid pressure drop at the commencement of the injection operation is caused by the absence of an accumulator chamber 22 in the injection valve 18. The afterfeed from the common rail then causes a pronounced pressure rise up to about 1700 bar. As may be gathered from FIG. 14, this oscillation is repeated again, slightly damped, within the injection interval Te. The even greater pressure fluctuations after the end of the injection operation are caused by the returning, virtually undamped pressure wave.

FIG. 15 shows, by the unbroken line, the throughflow of fuel through the nozzle 34 of the injecting injection valve 18, and the dashed line shows the afterflow of fuel into the respective accumulator chamber at the inlet of this accumulator chamber 22 (at 58 in FIG. 2) of the accumulator injection system 10 according to the invention. It may be gathered from this illustration that a highly regular injection of fuel over the entire injection interval Te is achieved in the first part of the injection operation, up to the time point designated by X, owing to the respective accumulator chamber 22 and, subsequently, owing to the after filling of this accumulator chamber 22 with fuel from other accumulator chambers 22, in particular adjacent injection units 27, and from the high-pressure conveying device 12. In particular, up to the time point X, part of the injection quantity comes from the accumulator chamber 22 of the injection valve 18 just operating, and, at the same time, the pressure in the accumulator chamber 22 falls (FIG. 13). At the time point X, an equilibrium prevails between the extraction of fuel and the afterfeed stream from the adjacent accumulator chambers 22 and from the high-pressure conveying device 12. The pressure profile is horizontal at this time point, see FIG. 13. After the time point X, the afterflow is greater than the fuel extraction, and the pressure in the accumulator chamber 22 of the injection valve 18 just operating rises again. When, at the end of injection, the pressure in this accumulator chamber 22 is again equal to the initial pressure at the commencement of injection, the overall afterflow quantity is equal to the injected quantity.

In comparison with this, as shown in FIG. 16, in the injection system with a common rail the throughflow rate through the nozzle of the injection valve 18—unbroken line—is more irregular and the afterflow of fuel at the inlet of the injection valve 18 is also associated with a high degree of unsteadiness. Underfeed and overfeed occur alternately at the nozzle, and the overall injection operation is much more dynamic and more uncontrollable than in the accumulator injection system according to the invention.

The invention claimed is:

1. An accumulator injection system for the intermittent injection of high-pressure fuel into combustion spaces of an internal combustion engine, with a high-pressure conveying device which feeds high-pressure fuel to a number of injection units having in each case an injection valve, a discrete accumulator chamber assigned to each injection valve and a throttling device, the injection units being connected to one another and to the high-pressure conveying device by means of hydraulic line means, and each injection valve having an injection valve member, actuated by means of an actuator arrangement and a hydraulic control device, for controlling the operation of injecting high-pressure fuel through nozzle injection orifices of a nozzle of the injection valve, wherein the hydraulic line means have too low an accumulator action to ensure the required, reproducibly identical injection operations of the injection valves, and the throttling device permits, at least approximately unimpeded, the flow of the high-pressure fuel in the direction of the injection valve and throttles said flow in the opposite direction, in such a way that high-pressure fuel flows to each injection valve during its injection operation both from the assigned accumulator chamber and from the accumulator chamber of other injection units and from the high-pressure conveying device.

2. The accumulator injection system as claimed in claim 1, wherein each throttling device has a nonreturn valve and, preferably in a parallel connection, a bypass throttle.

3. The accumulator injection system as claimed in claim 1, wherein the throttling device is arranged between the line means and the accumulator chamber, and the accumulator chamber is connected to the injection valve via a connecting duct.

4. The accumulator injection system as claimed in claim 3, wherein the throttling device has a nonreturn valve with bypass throttle, the nonreturn valve opening in the direction of the accumulator chamber.

5. The accumulator injection system as claimed in claim 1, wherein the accumulator chamber and the injection valve are connected to one another via a connecting duct, the throttling device is connected into the connecting duct, and the line means issue into the connecting duct between the throttling device and the accumulator chamber.

6. The accumulator injection system as claimed in claim 1, wherein the accumulator chamber and the injection valve are connected to one another via a connecting duct, the throttling device is connected into the connecting duct, and the line means issue into the connecting duct between the throttling device and the injection valve.

7. The accumulator injection system as claimed in claim 5, wherein the throttling device has a nonreturn valve with bypass throttle, the nonreturn valve opening in the direction of the injection valve.

8. The accumulator injection system as claimed in claim 1, wherein the nonreturn valve has a needle-shaped closing member, loaded in the closing direction by a spring, for closing and opening the nonreturn valve, and in that the bypass throttle is manufactured in the closing member.

9. The accumulator injection system as claimed in claim 1, wherein the line means have a fuel feedline leading away from the high-pressure conveying device and, per injection valve, a fuel line, the fuel lines issuing into the fuel feedline.

10. The accumulator injection system as claimed in claim 1, wherein the line means have a fuel feedline leading away from the high-pressure conveying device, at least one distributor block and, per injection valve, a fuel line, the fuel lines and the fuel feedline issuing into the distributor block and being flow-connected to one another there.

11. The accumulator injection system as claimed in claim 10, wherein, in the distributor block, at least one double-acting throughflow limiting valve is installed, which interrupts the inflow to one of two fuel lines when the injection valve member of the respective injection valve unintentionally remains in the open position for too long a time.

12. The accumulator injection system as claimed in claim 10, wherein, in a distributor block, at least one single-acting throughflow limiting valve is installed, which interrupts the inflow to at least two fuel lines when the injection valve member of at least one of the respective at least two injection valves unintentionally remains in the open position for too long a time.

13. The accumulator injection system as claimed in claim 10, wherein the distributor block is assigned an additional accumulator chamber, the accumulator volume of which corresponds preferably at least approximately to that of an accumulator chamber of an injection unit.

14. The accumulator injection system as claimed in claim 1, wherein the high-pressure conveying device has a plurality of high-pressure conveying pumps, preferably a high-pressure conveying pump per injection unit, and the line means have a fuel pump line leading away from each high-pressure conveying pump, a fuel feedline and, per injection valve, a fuel line, the fuel pump lines and the fuel lines issuing into the fuel feedline.

15. The accumulator injection system as claimed in claim 14, wherein the high-pressure conveying pumps have short-conveying cams.

16. The accumulator injection system as claimed in claim 14, wherein the pumping operation of each high-pressure conveying pump overlaps at least partially with the injection operation of the assigned injection unit.

* * * * *